US011193224B2

(12) United States Patent
Ueda

(10) Patent No.: US 11,193,224 B2
(45) Date of Patent: Dec. 7, 2021

(54) EMBROIDERY FRAME TRANSPORT DEVICE AND SEWING MACHINE

(71) Applicant: BROTHER KOGYO KABUSHIKI KAISHA, Nagoya (JP)

(72) Inventor: Daisuke Ueda, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 21 days.

(21) Appl. No.: 16/891,884

(22) Filed: Jun. 3, 2020

(65) Prior Publication Data

US 2020/0291560 A1 Sep. 17, 2020

Related U.S. Application Data

(63) Continuation of application No. PCT/JP2018/044868, filed on Dec. 6, 2018.

(30) Foreign Application Priority Data

Dec. 27, 2017 (JP) ..... JP2017-250911

(51) Int. Cl.
*D05B 39/00* (2006.01)
*D05C 1/02* (2006.01)

(52) U.S. Cl.
CPC ..... *D05B 39/00* (2013.01); *D05C 1/02* (2013.01)

(58) Field of Classification Search
CPC .. D05B 39/00; D05B 73/00; D05B 73/02–12; D05B 21/00; D05C 1/02
See application file for complete search history.

(56) References Cited

U.S. PATENT DOCUMENTS 5,291,843 A * 3/1994 Hori ..... D05B 3/243 112/103
5,353,725 A * 10/1994 Sakakibara ..... D05C 9/04 112/103

(Continued)

FOREIGN PATENT DOCUMENTS

DE 3201014 C1 10/1983
JP H06-2254 A 1/1994

(Continued)

OTHER PUBLICATIONS

Jun. 30, 2020 International Preliminary Reporton Patentability issued in International Patent Application No. PCT/JP2018/044868.

(Continued)

*Primary Examiner* — Ismael Izaguirre
(74) *Attorney, Agent, or Firm* — Oliff PLC

(57) ABSTRACT

An embroidery frame transport device includes a guide portion, a lever, and a locking portion. The guide portion is configured to prescribe a first direction being a movement direction when the embroidery frame is removed and a second direction being a movement direction when the embroidery frame is mounted. The lever is configured to move between a first restriction position that restricts the movement in the first direction of the embroidery frame and a first release position that does not restrict the movement in the first direction of the embroidery frame. The locking portion is configured to move between a second restriction position that restricts the movement in the second direction of the embroidery frame and a second release position that does not restrict the movement in the second direction of the embroidery frame.

10 Claims, 17 Drawing Sheets

(56) References Cited

U.S. PATENT DOCUMENTS

| | | | | |
|---|---|---|---|---|
| 5,630,370 | A * | 5/1997 | Herbach | D05C 9/04 112/103 |
| 2006/0011122 | A1 | 1/2006 | Yoshida | |
| 2015/0000574 | A1* | 1/2015 | Kawaguchi | D05C 9/04 112/103 |
| 2018/0355534 | A1 | 12/2018 | Kato | |
| 2018/0371662 | A1 | 12/2018 | Fujihara | |

FOREIGN PATENT DOCUMENTS

| | | | |
|---|---|---|---|
| JP | 2770045 | B2 | 6/1998 |
| JP | 2005-334030 | A | 12/2005 |
| JP | 2006-14800 | A | 1/2006 |
| JP | 2017-164212 | A | 9/2017 |
| JP | 2017-169877 | A | 9/2017 |

OTHER PUBLICATIONS

Feb. 26, 2019 International Search Report issued in International Patent Application No. PCT/JP2018/044868.

* cited by examiner

EMBROIDERY FRAME TRANSPORT DEVICE AND SEWING MACHINE

CROSS-REFERENCE TO RELATED APPLICATION

This application is a Continuation Application of International Application No. PCT/JP2018/044868, filed Dec. 6, 2018, which claims priority from Japanese Patent Application No. 2017-250911, filed on Dec. 27, 2017. This disclosure of the foregoing application is hereby incorporated by reference in its entirety.

BACKGROUND

The present disclosure relates to an embroidery frame transport device and a sewing machine.

There is a sewing machine that uses an embroidery frame transport device to retract an embroidery frame to a desired needle drop position in order to attach and remove a lower thread bobbin when a lower thread runs out during embroidery sewing. A user of the sewing machine can replace the lower thread bobbin via a bobbin insertion opening, in a state in which the embroidery frame is retracted from above the bobbin insertion opening.

SUMMARY

In the above-described sewing machine, the retraction of the embroidery frame from above the bobbin insertion opening is limited within a transportable range of the embroidery frame by the embroidery frame transport device. Therefore, when a large embroidery frame is attached to the embroidery frame transport device, the embroidery frame may not be retracted from above the bobbin insertion opening.

It is an object of the present disclosure to provide an embroidery frame transport device capable of increasing a possibility that an embroidery frame can be retracted from above a bobbin insertion opening of a needle plate, and a sewing machine provided with the embroidery frame transport device.

Various embodiments herein provide an embroidery frame transport device that includes a guide portion, a lever, and a locking portion. The guide portion is provided on a carriage on which a coupling portion of an embroidery frame is configured to be mounted and removed. The guide portion is configured to prescribe a first direction that is a movement direction of the embroidery frame when the embroidery frame is removed, and a second direction that is a movement direction of the embroidery frame when the embroidery frame is mounted. The lever is configured to move between a first restriction position that restricts the movement in the first direction of the embroidery frame in a mounted state in which the embroidery frame is mounted on the carriage, and a first release position that does not restrict the movement in the first direction of the embroidery frame in the mounted state. The locking portion is configured to move between a second restriction position that restricts the movement in the second direction of the embroidery frame in the mounted state, and a second release position that does not restrict the movement in the second direction of the embroidery frame in the mounted state.

Various embodiments also provide a sewing machine that includes an embroidery frame transport device and an embroidery frame. The embroidery frame transport device includes a guide portion, a lever, and a locking portion. The guide portion is provided on a carriage on which a coupling portion of the embroidery frame is configured to be mounted and removed. The guide portion is configured to prescribe a first direction that is a movement direction of the embroidery frame when the embroidery frame is removed, and a second direction that is a movement direction of the embroidery frame when the embroidery frame is mounted. The lever is configured to move between a first restriction position that restricts the movement in the first direction of the embroidery frame in a mounted state in which the embroidery frame is mounted on the carriage, and a first release position that does not restrict the movement in the first direction of the embroidery frame in the mounted state. The locking portion is configured to move between a second restriction position that restricts the movement in the second direction of the embroidery frame in the mounted state, and a second release position that does not restrict the movement in the second direction of the embroidery frame in the mounted state. The embroidery frame includes a contact portion which is provided on a frame portion configured to clamp a sewing object, and which is provided further to the first direction side than the coupling portion in the mounted state. The embroidery frame transport device further includes a restriction portion that restricts the movement of the embroidery frame in the second direction by coming into contact with the contact portion of the embroidery frame that is moved in the second direction along the guide portion, in a state in which the locking portion is disposed in the second release position.

BRIEF DESCRIPTION OF DRAWINGS

Embodiments will be described below in detail with reference to the accompanying drawings in which.

DETAILED DESCRIPTION

Schematic Configuration of Sewing Machine 1, Embroidery Frame Transport Device 40 and Embroidery Frame 50

Figure 1:
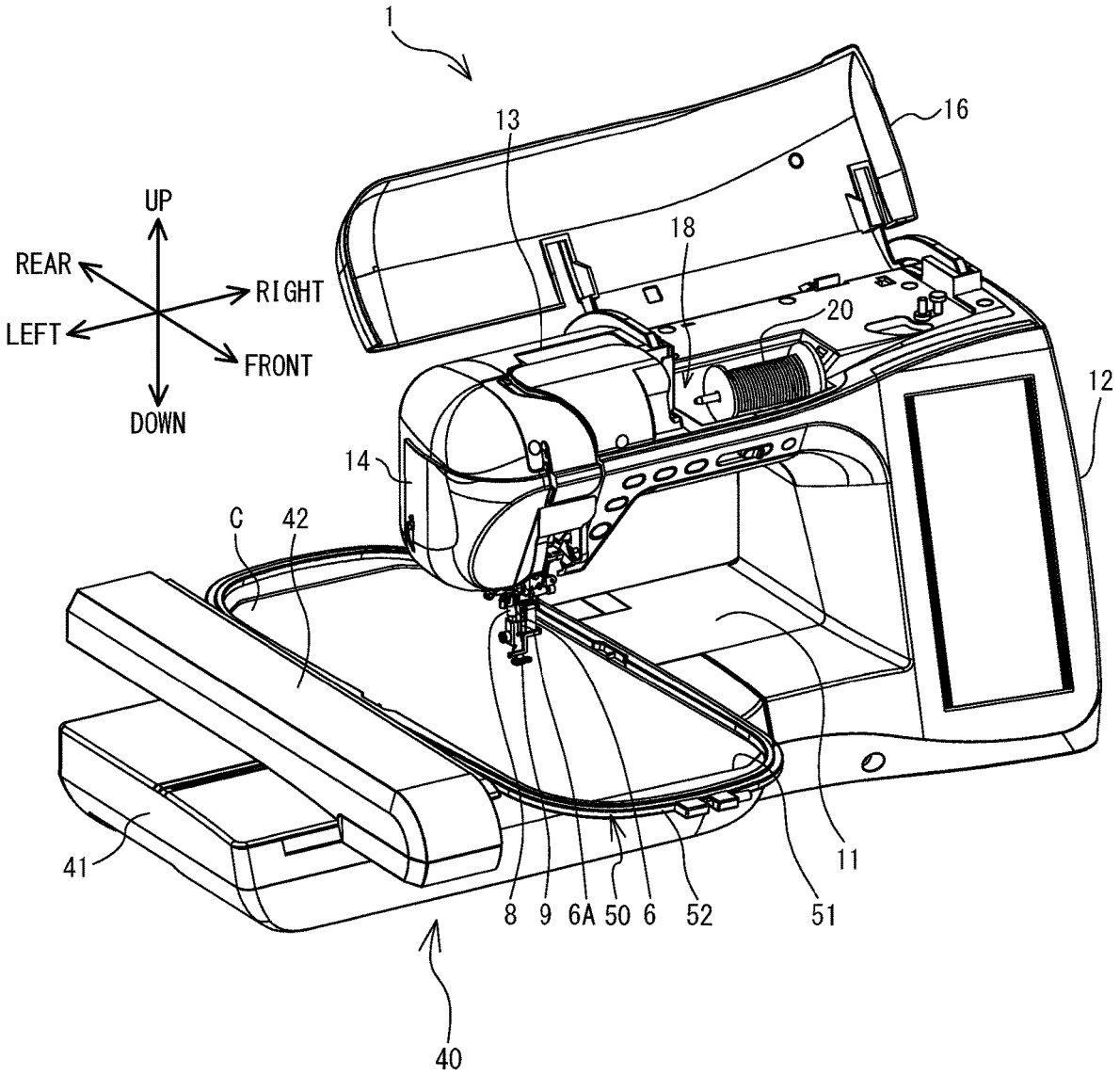
FIG. 1 is a perspective view of a sewing machine 1 on which an embroidery frame transport device 40 is mounted.

An embodiment of the present disclosure will be explained with reference to the drawings. A physical configuration of the sewing machine 1 on which the embroidery frame transport device 40 is mounted will be explained with reference to FIG. 1 and FIG. 2. The up-down direction, the lower right side, the upper left side, the lower left side and the upper right side in FIG. 1 are respectively the up-down direction, the front side, the rear side, the left side and the right side of the sewing machine 1 on which the embroidery frame transport device 40 is mounted. A long side direction of a bed portion 11 and an arm portion 13 is the left-right direction of the sewing machine 1. A side of the bed portion 11 on which a pillar 12 is disposed is the right side. An extending direction of the pillar 12 is the up-down direction of the sewing machine 1. Unless otherwise noted, a rotation direction (a clockwise direction/a counterclockwise direction) will be explained assuming that the sewing machine 1 and the embroidery frame transport device 40 are viewed from the right side.

As shown in FIG. 1, the sewing machine 1 is provided with the bed portion 11, the pillar 12, the arm portion 13 and a head portion 14. The bed portion 11 is a base portion of the sewing machine 1 and extends in the left-right direction. The pillar 12 extends upward from the right end portion of the bed portion 11. The arm portion 13 extends to the left from the upper end of the pillar 12 such that the arm portion 13 faces the bed portion 11. The head portion 14 is coupled to the left leading end portion of the arm portion 13.

The sewing machine 1 is provided with a feed dog, a feed mechanism, a shuttle mechanism and the like (which are not shown in the drawings) inside the bed portion 11. During normal sewing other than embroidery sewing, the feed dog is driven by the feed mechanism, and moves a sewing object C by a predetermined movement amount. The shuttle mechanism entwines an upper thread (not shown in the drawings) with a lower thread (not shown in the drawings) below a needle plate 11A (refer to FIG. 2) that is provided on the upper surface of the bed portion 11. A sewing machine motor (not shown in the drawings) is provided inside the pillar 12. A cover 16 that can open and close is provided on an upper portion of the arm portion 13. FIG. 1 shows a state in which the cover 16 is open. A thread housing portion 18 is provided below the cover 16 (inside the arm portion 13). The thread housing portion 18 can house a thread spool 20 around which the upper thread is wound. A drive shaft (not shown in the drawings) that extends in the left-right direction is provided inside the arm portion 13. The drive shaft is rotationally driven by the sewing machine motor. The head portion 14 is provided with a needle bar 6, a presser bar 8 and the like. A sewing needle 6A is detachably mounted on the lower end of the needle bar 6. A presser foot 9 is detachably attached to the lower end portion of the presser bar 8. The needle bar 6 is driven in the up-down direction by the rotation of the drive shaft.

Figure 2:
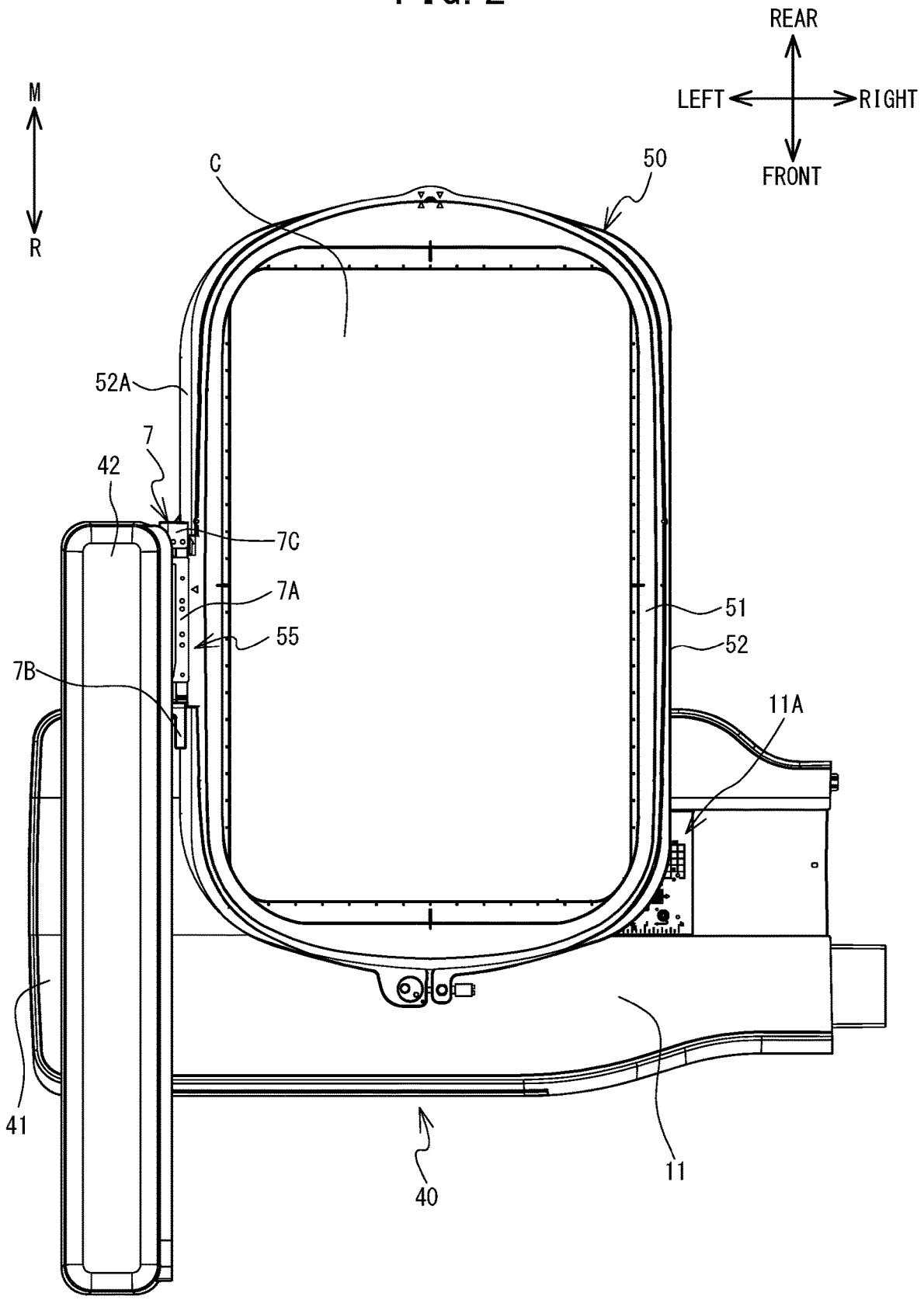
FIG. 2 is a view when the embroidery frame transport device 40, on which an embroidery frame 50 is mounted, is viewed from above.

As shown in FIG. 1 and FIG. 2, the embroidery frame transport device 40 is configured to be able to move the sewing object C held by the embroidery frame 50 with respect to the needle bar 6. The embroidery frame transport device 40 is provided with a main body portion 41 and a carriage 42. The carriage 42 is provided with a holder 7, a Y axis movement mechanism (not shown in the drawings) and a Y axis motor (not shown in the drawings). The holder 7 is provided on the right side surface of the carriage 42. A coupling portion 55 of the embroidery frame 50 is detachably mounted on the holder 7. The Y axis movement mechanism moves the holder 7 in the front-rear direction (a Y axis direction). The Y axis motor drives the Y axis movement mechanism. The configuration of the holder 7 will be described in more detail later. FIG. 2 shows a state in which the holder 7 is moved to the rearmost side within a movable range of the holder 7 by the Y axis movement mechanism. In this state, the needle plate 11A, particularly, a bobbin insertion opening 110 (refer to FIG. 16) is covered from above by the embroidery frame 50.

The main body portion 41 is internally provided with an X axis movement mechanism (not shown in the drawings) and an X axis motor (not shown in the drawings). The X axis movement mechanism moves the carriage 42 in the left-right direction (an X axis direction). The X axis motor drives the X axis movement mechanism. When the embroidery sewing is performed using the embroidery frame 50, the embroidery frame transport device 40 can move the embroidery frame 50 mounted on the holder 7 of the carriage 42 to a position indicated by a unique XY coordinate system (an embroidery coordinate system).

Figure 3:
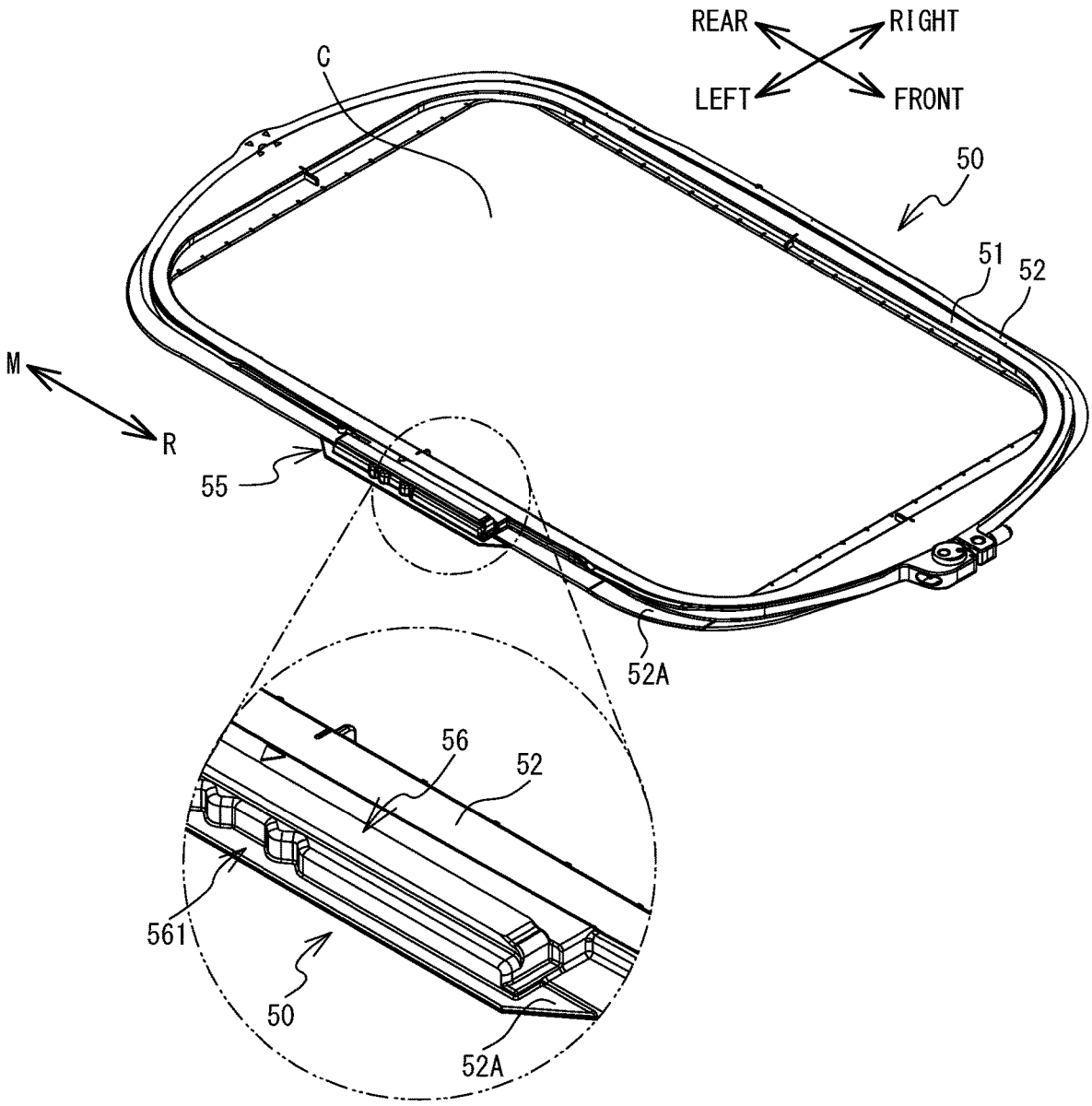
FIG. 3 is a perspective view and a partially enlarged view of the embroidery frame 50.
Figure 6:
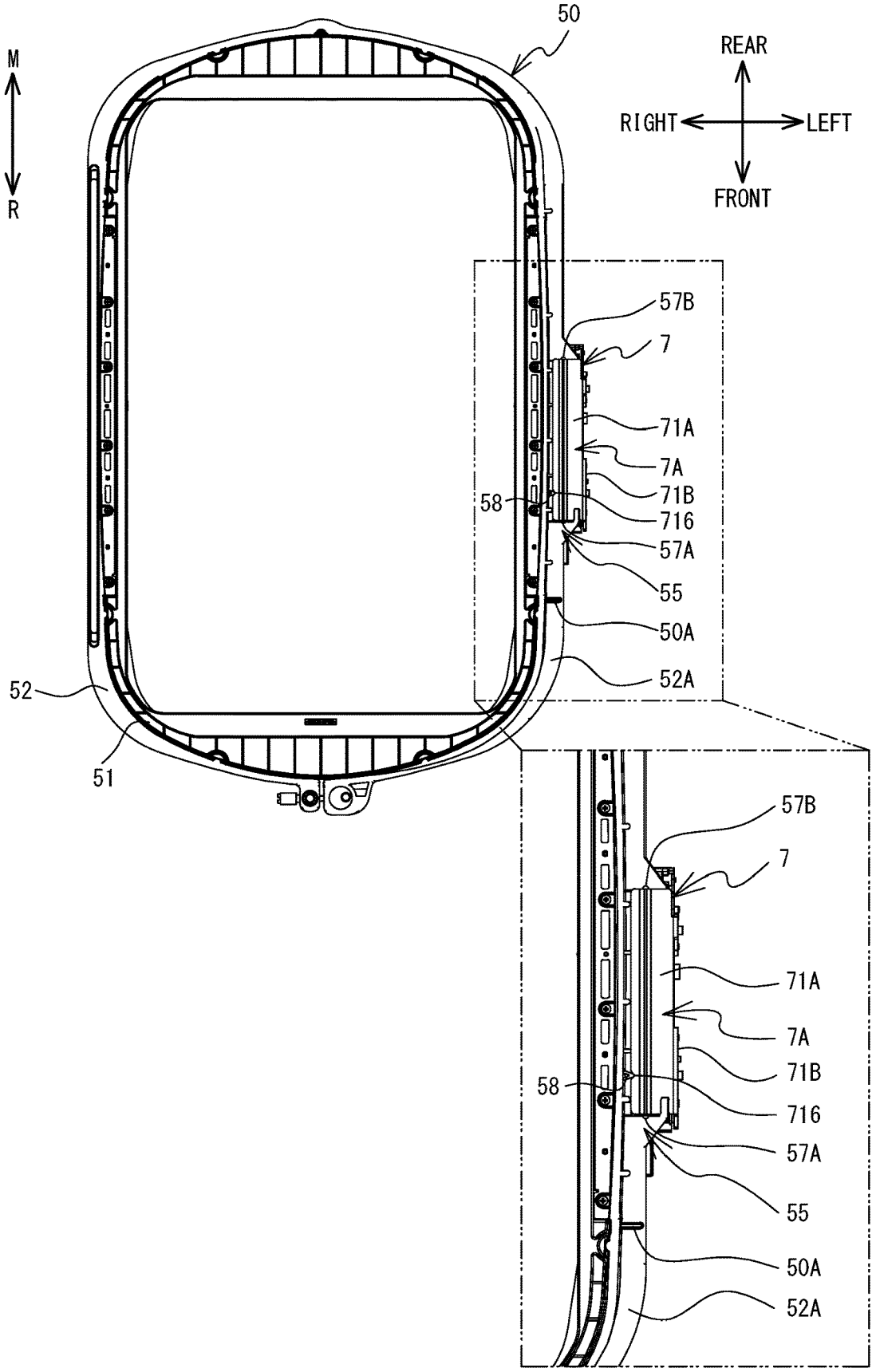
FIG. 6 is a view when the embroidery frame 50 held by the embroidery frame transport device 40 is viewed from below.

As shown in FIG. 3, the embroidery frame 50 has a first frame 51, a second frame 52, the coupling portion 55 and a contact portion 50A (refer to FIG. 6). The first frame 51 and the second frame 52 of the embroidery frame 50 can clamp the sewing object C. A plate-shaped portion 52A is provided on the left side of the second frame 52. The plate-shaped portion 52A is orthogonal to the up-down direction, and extends from the front end portion to the rear end portion of the second frame 52. The coupling portion 55 is provided on the left side of the second frame 52, at the center of the second frame 52 in the front-rear direction. The coupling portion 55 will be described in more detail later. As shown in FIG. 6, the contact portion 50A is provided on the lower surface of the plate-shaped portion 52A, at a position separated forward from the coupling portion 55. The contact portion 50A protrudes downward and extends in the left-right direction between the left and right end portions of the plate-shaped portion 52A.

Figure 4:
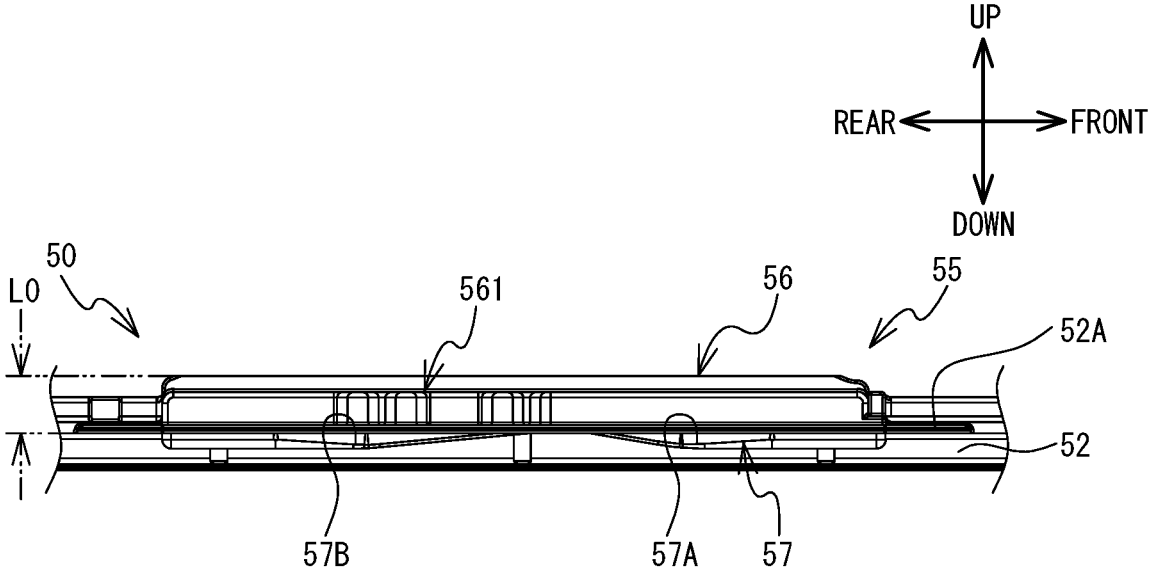
FIG. 4 is a left side view of the embroidery frame 50.
Figure 5:
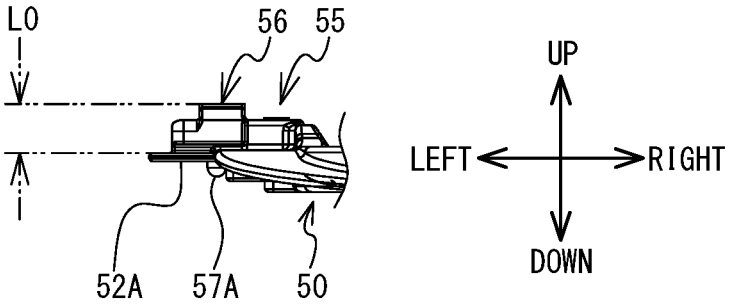
FIG. 5 is a front view of the embroidery frame 50.

As shown in FIG. 3 to FIG. 6, the coupling portion 55 is provided with a base portion 56 (refer to FIG. 3), a guide portion 57 (refer to FIG. 4) and a fourth engagement portion 58 (refer to FIG. 6). As shown in FIG. 3, the base portion 56 has a substantially cuboid shape that is long in the front-rear direction. The base portion 56 is provided at the center of the embroidery frame 50 in the front-rear direction, and on the upper surface of the plate-shaped portion 52A. Hereinafter, as shown in FIG. 4 and FIG. 5, a distance in the up-down direction between the upper end portion of the base portion 56 and the lower end portion of the plate-shaped portion 52A is referred to as a "thickness of the coupling portion 55" and is denoted by L0. As shown in FIG. 3, a plurality of protruding portions 561 that protrude leftward are provided on the left side surface of the base portion 56. The number and the arrangement of the plurality of protruding portions 561 are different for each type of the embroidery frame 50.

As shown in FIG. 4 and FIG. 5, the guide portion 57 is provided on the lower surface of the plate-shaped portion 52A, at a position below the base portion 56. The guide portion 57 has protruding portions 57A and 57B that are separated from each other in the front-rear direction. The protruding portions 57A and 57B each have a plate shape that is orthogonal to the left-right direction. The protruding portion 57A is disposed to the front of the protruding portion 57B. As shown in FIG. 6, the fourth engagement portion 58 is provided on the lower surface of the plate-shaped portion 52A, at a position below the base portion 56 and to the front of the center of the base portion 56 in the front-rear direction. The fourth engagement portion 58 protrudes downward from the plate-shaped portion 52A. The fourth engagement portion 58 is an elastically deformable plate spring, and has a plate shape that is curved at an acute angle. A protruding end of the fourth engagement portion 58 is directed to the left. An amount of leftward protrusion of the fourth engagement portion 58 can be changed by the elastic deformation.

As shown in FIG. 2, the embroidery frame 50 is mounted on the carriage 42 of the embroidery frame transport device 40, by the coupling portion 55 moving in the rearward direction with respect to the holder 7 (to be described later) of the carriage 42. On the other hand, the embroidery frame 50 is removed from the carriage 42 of the embroidery frame transport device 40, by the coupling portion 55 moving in the forward direction with respect to the holder 7. Hereinafter, when the embroidery frame 50 is removed, the direction (the forward direction) in which the embroidery frame 50 moves with respect to the embroidery frame transport device 40 is also referred to as a "first direction R." When the embroidery frame 50 is mounted, the direction (the rearward direction) in which the embroidery frame 50 moves with respect to the embroidery frame transport device 40 is also referred to as a "second direction M."

Holder 7

The holder 7 will be explained with reference to FIG. 7 to FIG. 9. The holder 7 is mainly provided with an attachment portion 7A, a lever 7B, a locking portion 7C, a coupling mechanism 7D and a link 7E. The holder 7 is provided on the carriage 42 (refer to FIG. 1 and FIG. 2), and the coupling portion 55 of the embroidery frame 50 is detachably mounted thereon.

Attachment Portion 7A

The attachment portion 7A has a C shape in a front view, and the right side thereof is open. The attachment portion 7A has plate-shaped portions 71A, 71B and 71C. The plate-shaped portion 71A faces the bed portion 11 (refer to FIG. 1) of the sewing machine 1 when the embroidery frame transport device 40 is attached to the sewing machine 1. The plate-shaped portion 71A corresponds to a lower side section of the attachment portion 7A having the C shape in the front view. The plate-shaped portion 71A is provided with a groove-shaped guide portion 711 that extends parallel to the long side direction of the holder 7. The guide portion 711 comes into contact with the guide portion 57 (refer to FIG. 3 to FIG. 5) provided on the coupling portion 55 of the embroidery frame 50, and prescribes the first direction R (the forward direction) and the second direction M (the rearward direction) of the embroidery frame 50. The plate-shaped portion 71A is further provided with a third engagement portion 716 at the right end portion thereof. The third engagement portion 716 is provided in the vicinity of the front end of the holder 7 and is recessed to the left (refer to FIG. 17). The fourth engagement portion 58 (refer to FIG. 6) of the coupling portion 55 can engage with the third engagement portion 716.

The plate-shaped portion 71B extends in the upward direction from the left end portion of the plate-shaped portion 71A. The plate-shaped portion 71B faces the Y axis movement mechanism (not shown in the drawings) of the carriage 42. The plate-shaped portion 71B corresponds to a left side section of the attachment portion 7A having the C shape in the front view. A columnar first rotary shaft 712 is provided on the front end portion of the right surface of the plate-shaped portion 71B. The first rotary shaft 712 protrudes rightward from substantially the center of the plate-shaped portion 71B in the up-down direction. A columnar second rotary shaft 713 is provided on the rear end portion of the right surface of the plate-shaped portion 71B. The second rotary shaft 713 protrudes leftward from above the center of the plate-shaped portion 71B in the up-down direction. A plurality of sensors 714 are provided at a central portion, in the front-rear direction, of the right surface of the plate-shaped portion 71B. The plurality of sensors 714 are proximity sensors that can detect the approach of the plurality of protruding portions 561 (refer to FIG. 3 to FIG. 5) of the coupling portion 55 when the embroidery frame 50 is mounted. A second engagement portion 715 is provided in the vicinity of the front end portion of the plate-shaped portion 71B. The second engagement portion 715 is an elastically deformable plate spring and has a curved plate shape. The second engagement portion 715 can engage with a first engagement portion 723 of the lever 7B to be described later. A columnar protruding portion 718 that protrudes rightward is provided to the rear of the second engagement portion 715 of the plate-shaped portion 71B.

The plate-shaped portion 71C extends in the rightward direction from the upper end portion of the plate-shaped portion 71B. The plate-shaped portion 71C faces the plate-shaped portion 71A. The plate-shaped portion 71C corresponds to an upper side section of the attachment portion 7A having the C shape in the front view. Hereinafter, a section of the attachment portion 7A that is surrounded by the plate-shaped portions 71A and 71B and 71C is referred to as an "inner section of the attachment portion 7A."

Lever 7B

The lever 7B is rotatably supported by the front end portion of the attachment portion 7A. The lever 7B has a base portion 72A, a contact portion 72B and an operation portion 72C. The base portion 72A has a plate shape and is orthogonal to the left-right direction. The base portion 72A is disposed in proximity to the right surface of the plate-shaped portion 71B of the attachment portion 7A. The first rotary shaft 712 that extends from the plate-shaped portion 71B of the attachment portion 7A is inserted through a hole (not shown in the drawings) of the base portion 72A, and rotatably supports the base portion 72A. Thus, the lever 7B is able to rotate around the first rotary shaft 712. The base portion 72A has a groove cam 722 and the first engagement portion 723.

The groove cam 722 extends in a substantial arc shape taking, as a reference, the center of rotation of the first rotary shaft 712. The groove cam 722 has a first section S1 and a second section S2. Hereinafter, when the configuration of the groove cam 722 is explained on the basis of the rotation direction (the clockwise direction/the counterclockwise direction), it is assumed that the center of the rotation is the first rotary shaft 712. The first section S1 is disposed on the counterclockwise direction side with respect to the second section S2. An end portion of the first section S1 on the clockwise direction side is coupled to an end portion of the second section S2 on the counterclockwise direction side. A distance of the second section S2 from the first rotary shaft 712 is the same over the extending direction of the second section S2. A distance of the first section S1 from the first rotary shaft 712 is gradually reduced from the end portion of the first section S1 on the clockwise direction side (the end portion of the first section S1 on the second section S2 side) toward an end portion of the first section S1 on the counterclockwise direction side.

The first engagement portion 723 is provided at an end portion of the base portion 72A. The first engagement portion 723 is recessed toward the center of rotation of the first rotary shaft 712. The first engagement portion 723 engages with the second engagement portion 715 provided on the attachment portion 7A, in a state in which the lever 7B is disposed in a specific position within a rotatable range of the lever 7B that rotates around the first rotary shaft 712 (refer to FIG. 8). Hereinafter, the position of the lever 7B (refer to FIG. 8) in a state in which the second engagement portion 715 is engaged with the first engagement portion 723 is referred to as a "first intermediate position." Further, the position of the lever 7B when the lever 7B is rotated as much as possible in the counterclockwise direction around the first rotary shaft 712 (refer to FIG. 7) is referred to as a "first restriction position," and the position of the lever 7B when the lever 7B is rotated as much as possible in the clockwise direction (refer to FIG. 9) is referred to as a "first release position." The first engagement portion 723 does not engage with the second engagement portion 715 provided on the attachment portion 7A in a state in which the lever 7B is disposed further to the first restriction position side than the first intermediate position, and in a state in which the lever 7B is disposed further to the first release position side than the first intermediate position.

The contact portion 72B extends rightward from a section of the base portion 72A that is separated from the hole through which the first rotary shaft 712 is inserted. As shown in FIG. 7, in a state in which the lever 7B is disposed in the first restriction position, the contact portion 72B is disposed at the same position as the first rotary shaft 712 in the up-down direction, and to the front of the first rotary shaft 712 in the front-rear direction. As shown in FIG. 9, in a state in which the lever 7B is disposed in the first release position, the contact portion 72B is disposed above the first rotary shaft 712 in the up-down direction, and at the same position as the first rotary shaft 712 in the front-rear direction.

The operation portion 72C extends radially around the center of rotation of the first rotary shaft 712, from the opposite side of a connection section between the contact portion 72B and the base portion 72A. The operation portion 72C has a bar shape. As shown in FIG. 7, in the state in which the lever 7B is disposed in the first restriction position, the operation portion 72C extends horizontally forward from the contact portion 72B side toward the opposite side. As shown in FIG. 9, in the state in which the lever 7B is disposed in the first release position, the operation portion 72C extends vertically upward from the contact portion 72B side toward the opposite side. As shown in FIG. 8, in a state in which the lever 7B is disposed in the first intermediate position, the operation portion 72C extends forward and diagonally upward in an inclined manner from the contact portion 72B side toward the opposite side.

In the first restriction position (refer to FIG. 7), the lower end portion of the contact portion 72B of the lever 7B becomes closest to the plate-shaped portion 71A of the attachment portion 7A in the up-down direction. Hereinafter, a distance in the up-down direction between the lower end portion of the contact portion 72B of the lever 7B in the first restriction position and the plate-shaped portion 71A of the attachment portion 7A is referred to as a "lever distance L11." In the first intermediate position (refer to FIG. 8), the distance between the lower end portion of the contact portion 72B of the lever 7B and the plate-shaped portion 71A of the attachment portion 7A is greater than the lever distance L11 in the up-down direction. Hereinafter, the distance in the up-down direction between the lower end portion of the contact portion 72B of the lever 7B in the first intermediate position and the plate-shaped portion 71A of the attachment portion 7A is referred to as a "lever distance L12." In the first release position (refer to FIG. 9), the lower end portion of the contact portion 72B of the lever 7B becomes closest to the plate-shaped portion 71A of the attachment portion 7A in the up-down direction. Hereinafter, the distance in the up-down direction between the lower end portion of the contact portion 72B of the lever 7B in the first release position and the plate-shaped portion 71A of the attachment portion 7A is referred to as a "lever distance L13." Each of the lever distances increases in an order of L11, L12 and L13 (L11<L12<L13). The lever distance L11 is less than the thickness L0 (refer to FIG. 4) of the coupling portion 55 (L11<L0). The lever distances L12 and L13 are greater than the thickness L0 of the coupling portion 55 (L12, L13>L0). Magnitude relationships between the lever distances L11, L12 and L13 are not limited to those described above. For example, the lever distances L12 and L13 may be the same (L11<L12=L13).

Locking Portion 7C

The locking portion 7C is rotatably supported by the rear end portion of the attachment portion 7A. The locking portion 7C has plate-shaped portions 73A, 73B and 73C. The plate-shaped portion 73A extends rearward from the rear end portion of the plate-shaped portion 71B of the attachment portion 7A. The plate-shaped portion 73A has a rectangular shape and is orthogonal to the left-right direction. The second rotary shaft 713 that extends from the plate-shaped portion 71B of the attachment portion 7A is inserted through a hole (not shown in the drawings) of the plate-shaped portion 73A, and rotatably supports the plate-shaped portion 73A. Thus, the locking portion 7C is able to rotate around the second rotary shaft 713. The rear end portion of the right surface of the plate-shaped portion 73A is provided with a columnar rotary shaft 731. The rotary shaft 731 protrudes rightward from the lower end portion of the plate-shaped portion 73A.

The plate-shaped portion 73B extends rightward from the upper end portion of the plate-shaped portion 73A. A plate-shaped locking plate 732 is connected to the lower surface of the plate-shaped portion 73B. The locking plate 732 is an elastically deformable plate spring and is orthogonal to the front-rear direction. The locking plate 732 extends downward from the plate-shaped portion 73B, and further extends downward while curving in a convex shape toward the front. The plate-shaped portion 73C extends rightward from the rear end portion of the plate-shaped portion 73A. The rear end portion of the plate-shaped portion 73B is connected to the upper end portion of the plate-shaped portion 73C.

Coupling Mechanism 7D and Link 7E

The coupling mechanism 7D couples the lever 7B and the locking portion 7C via the link 7E to be described later. The coupling mechanism 7D is provided with a plate-shaped portion 74A. The plate-shaped portion 74A has a plate shape that is long in the front-rear direction and is orthogonal to the left-right direction. The plate-shaped portion 74A is disposed in proximity to the right surface of the plate-shaped portion 71B of the attachment portion 7A. The plate-shaped portion 74A has long holes 741 and 742 that extend in the front-rear direction. The protruding portion 718 that extends from the plate-shaped portion 71B of the attachment portion 7A is inserted through the long hole 741. The second rotary shaft 713 that extends from the plate-shaped portion 71B of the attachment portion 7A is inserted through the long hole 742. The protruding portion 718 and the second rotary shaft 713 support the coupling mechanism 7D via the long holes 741 and 742 such that the coupling mechanism 7D can move in the front-rear direction. Thus, the coupling mechanism 7D is able to move in the front-rear direction with respect to the attachment portion 7A.

The rear end portion of the plate-shaped portion 74A curves downward and extends in the downward direction. Hereinafter, the lower end portion of a section of the plate-shaped portion 74A that extends downward is referred to as a "leading end 744." The leading end 744 is disposed to the rear of the long hole 742 in the front-rear direction. A rotary shaft 751 is provided on the left surface of the leading end 744 of the plate-shaped portion 74A. The rotary shaft 751 protrudes leftward.

The link 7E is provided on the leading end 744 of the plate-shaped portion 74A. The coupling mechanism 7D is coupled to the locking portion 7C via the link 7E, further to the second direction M side (the rear side) than the second rotary shaft 713 that is inserted through the long hole 742. The link 7E is a long and thin plate-shaped member. The rotary shaft 751 provided on the leading end 744 of the plate-shaped portion 74A is inserted, from the right side, through a hole (not shown in the drawings) provided in an end portion (hereinafter referred to as a "one end portion 761") on the first direction R side (the front side) of the link 7E. The link 7E is coupled to the plate-shaped portion 74A such that the link 7E can rotate around the rotary shaft 751. The one end portion 761 of the link 7E is disposed lower than the second rotary shaft 713 in the up-down direction. The rotary shaft 731 provided on the locking portion 7C is inserted, from the right side, through a hole (not shown in the drawings) provided in an end portion (hereinafter referred to as an "other end portion 762") on the second direction M side (the rear side) of the link 7E. The link 7E is coupled to the locking portion 7C such that the link 7E can rotate around the rotary shaft 731. A direction extending from the one end portion 761 to the other end portion 762 of the link 7E (a direction of an arrow Y) is inclined upward with respect to the second direction M (the rearward direction).

A columnar cam follower 743 that protrudes rightward is provided on the front end portion of the right surface of the plate-shaped portion 74A of the coupling mechanism 7D. The cam follower 743 enters, from the left side, the groove cam 722 provided in the base portion 72A of the lever 7B. The cam follower 743 moves along the groove cam 722 in accordance with the rotation of the lever 7B. The coupling mechanism 7D moves in the front-rear direction in accordance with the movement of the cam follower 743. The details are as follows.

Figure 7:
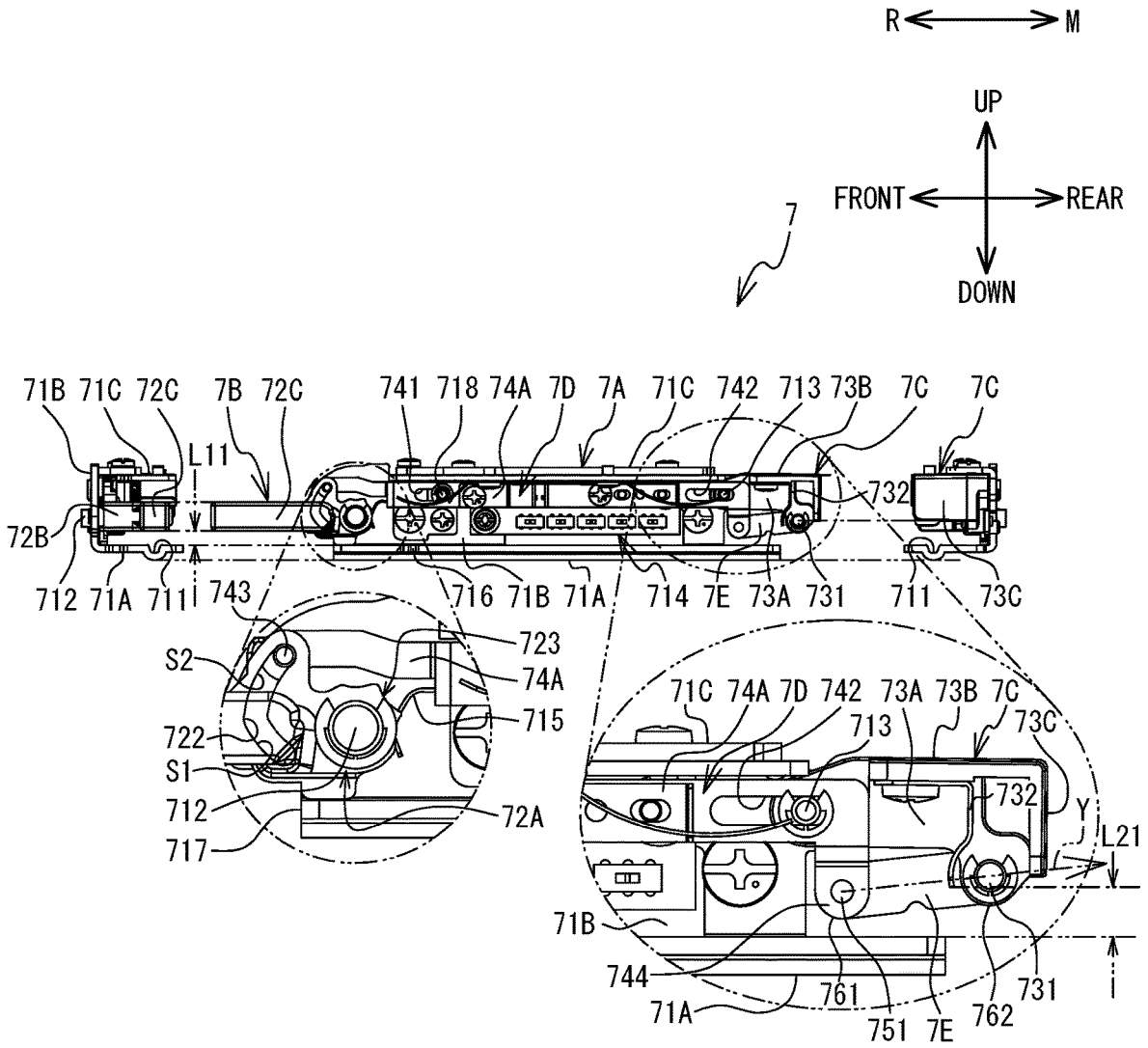
FIG. 7 is a right side view of the embroidery frame transport device 40 (a lever 7B is in a first restriction position and a locking portion 7C is in a second restriction position)

As shown in FIG. 7, in the state in which the lever 7B is disposed in the first restriction position, the cam follower 743 is disposed on an end portion on the clockwise direction side of the second section S2 of the groove cam 722. In this case, the coupling mechanism 7D is brought into a state in which it is moved as much as possible to the first direction R side (the front side). When the plate-shaped portion 74A of the coupling mechanism 7D is brought into the state in which it is moved as much as possible to the first direction R side (the front side), the link 7E causes the locking portion 7C to be disposed in a specific position (hereinafter referred to as a "second restriction position"). The second restriction position corresponds to a position when the locking portion 7C is rotated as much as possible in the clockwise direction around the second rotary shaft 713. In the second restriction position, a distance in the up-down direction between the lower end portion of the locking plate 732 of the locking portion 7C and the plate-shaped portion 71A of the attachment portion 7A is referred to as a "locking distance L21." The locking distance L21 is less than the thickness L0 (refer to FIG. 4) of the coupling portion 55 (L21<L0).

When the lever 7B rotates in the clockwise direction from the first restriction position (refer to FIG. 7) to the first intermediate position (refer to FIG. 8), the cam follower 743 relatively moves along the second section S2 of the groove cam 722, from an end portion of the second section S2 on the clockwise direction side to an end portion of the second section S2 on the counterclockwise direction side (an end portion of the second section S2 on the first section S1 side). Here, the distance of the second section S2 of the groove cam 722 from the first rotary shaft 712 is the same over the extending direction. Therefore, as shown in FIG. 8, the cam follower 743 does not move with respect to the attachment portion 7A, and the coupling mechanism 7D is maintained in a state in which it is moved as much as possible to the first direction R side (the front side). As a result, the locking portion 7C is also maintained in a state in which it is disposed in the second restriction position.

When the lever 7B rotates from the first intermediate position (refer to FIG. 8) to the first release position (refer to FIG. 9), the cam follower 743 relatively moves along the first section S1 of the groove cam 722, from an end portion of the first section S1 on the clockwise direction side (the end portion of the first section S1 on the second section S2 side) to the end portion of the first section S1 on the counterclockwise direction side. Here, the distance of the first section S1 of the groove cam 722 from the first rotary shaft 712 is gradually reduced from the end portion of the first section S1 on the clockwise direction side toward the end portion of the first section S1 on the counterclockwise direction side. Therefore, the cam follower 743 moves with respect to the attachment portion 7A, and the coupling mechanism 7D moves to the second direction M side (the rear side). In this case, the locking portion 7C receives a force from the link 7E in accordance with the movement of the coupling mechanism 7D, and rotates in the counterclockwise direction from the second restriction position around the second rotary shaft 713.

Figure 9:
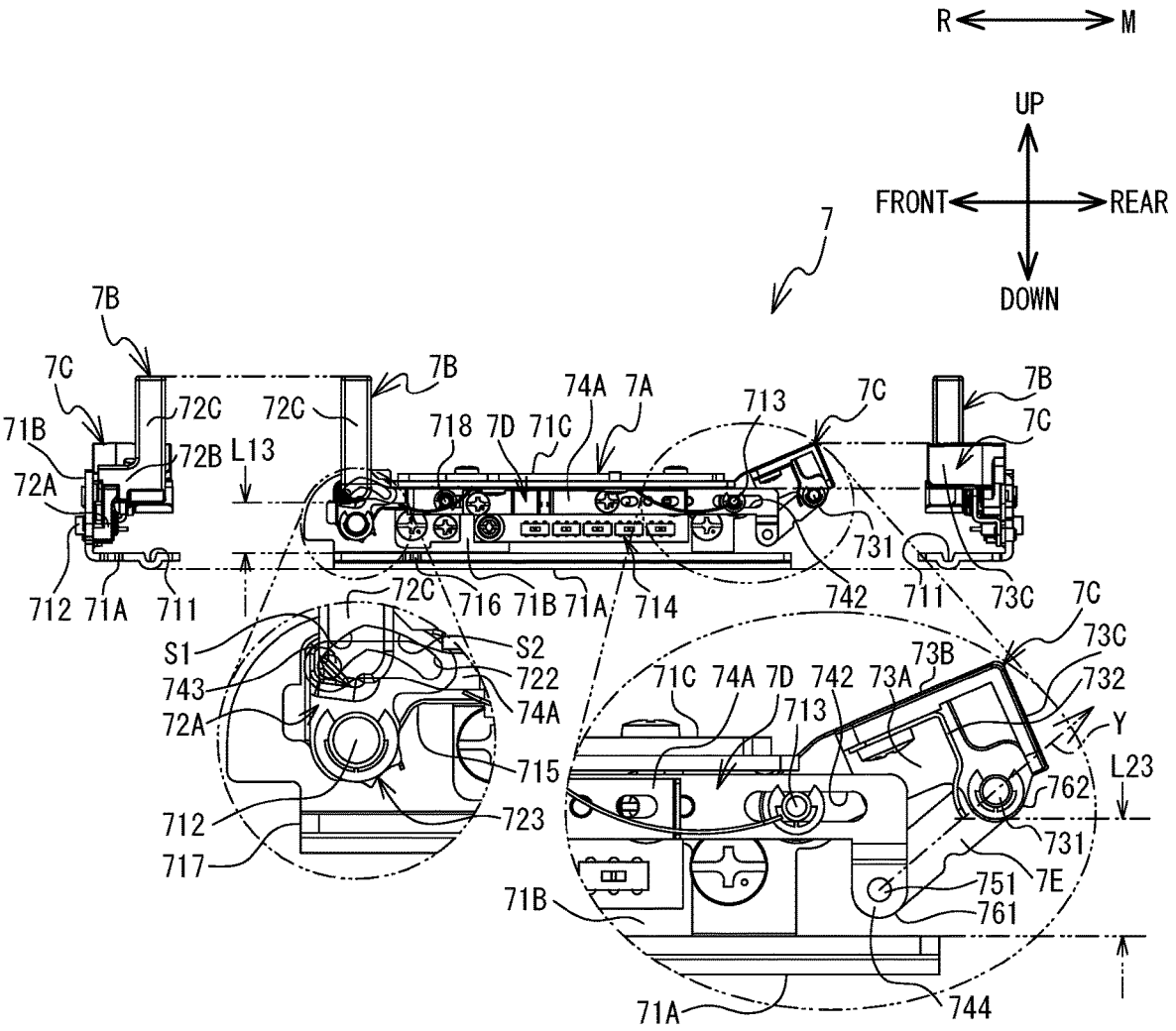
FIG. 9 is a right side view of the embroidery frame transport device 40 (the lever 7B is in a first release position and the locking portion 7C is in a second release position)
Figure 10:
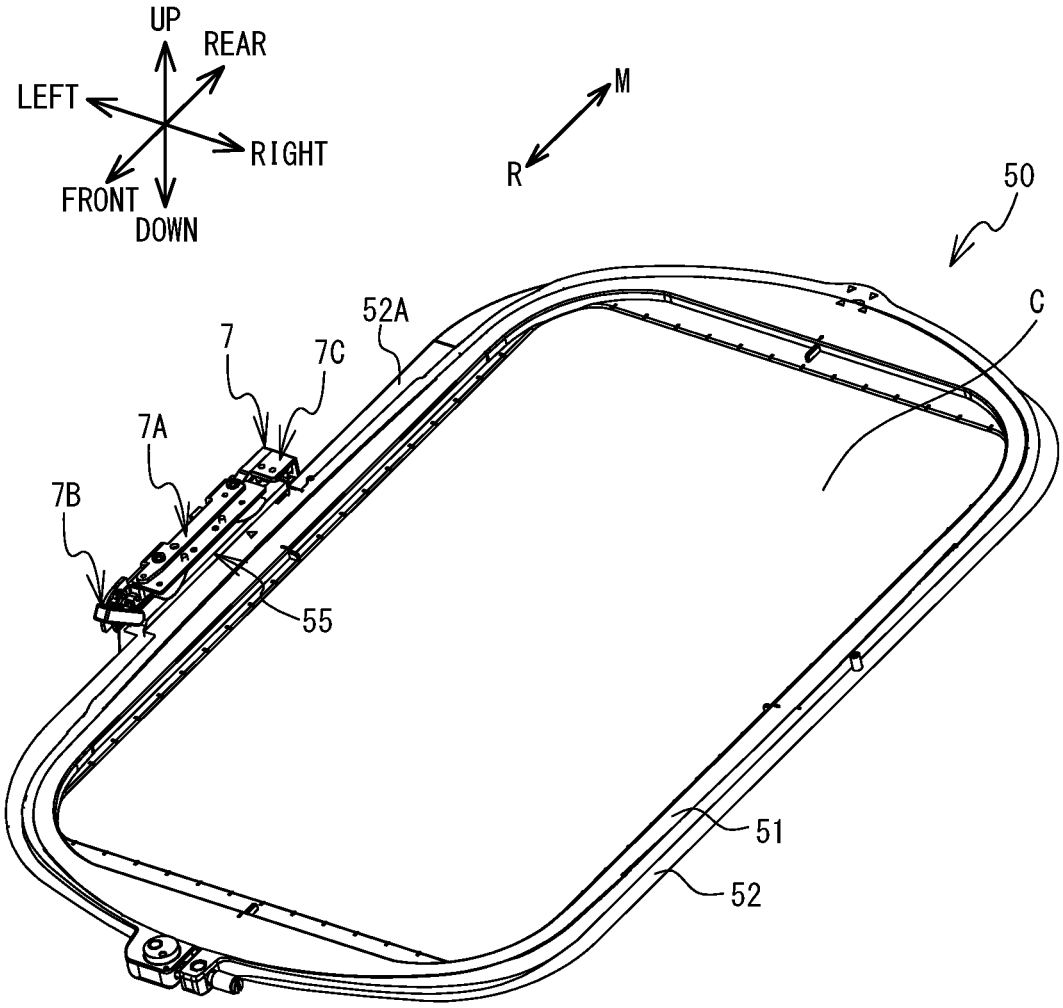
FIG. 10 is a perspective view showing the embroidery frame 50 held by the embroidery frame transport device 40 (the lever 7B is in the first intermediate position and the locking portion 7C is in the second restriction position)

As shown in FIG. 9, in the state in which the lever 7B is disposed in the first release position (refer to FIG. 9), the cam follower 743 is disposed at the end portion on the counterclockwise direction side of the first section S1 of the groove cam 722. In this case, the coupling mechanism 7D is brought into a state in which it is moved as much as possible to the second direction M side (the rear side), and the locking portion 7C is brought into a state in which it is rotated as much as possible in the counterclockwise direction around the second rotary shaft 713. Hereinafter, the position of the locking portion 7C when the locking portion 7C is rotated as much as possible in the counterclockwise direction is referred to as a "second release position." In the second release position, the distance in the up-down direction between the lower end portion of the locking plate 732 of the locking portion 7C and the plate-shaped portion 71A of the attachment portion 7A is referred to as a "locking distance L23." The locking distance L23 is greater than the thickness L0 (refer to FIG. 4) of the coupling portion 55 (L23>L0).

While the lever 7B is being rotated from the first restriction position (refer to FIG. 7) to the first intermediate position (refer to FIG. 8), the coupling mechanism 7D does not move in the second direction M (the rearward direction) and maintains the locking portion 7C in the second restriction position. In contrast to this, when the lever 7B is moved from the first intermediate position to the first release position (refer to FIG. 9), the coupling mechanism 7D moves in the second direction M (the rearward direction) and causes the locking portion 7C to rotate from the second restriction position to the second release position. Meanwhile, when the lever 7B is rotated from the first release position (refer to FIG. 9) to the first intermediate position (refer to FIG. 8), the coupling mechanism 7D moves in the first direction R (the forward direction) and causes the locking portion 7C to rotate from the second release position to the second restriction position (refer to FIG. 8). In contrast to this, while the lever 7B is being rotated from the first intermediate position to the first restriction position (refer to FIG. 7), the coupling mechanism 7D does not move in the first direction R (the forward direction) and maintains the locking portion 7C in the second restriction position.

Mounting Operation of Embroidery Frame 50 with Respect to Embroidery Frame Transport Device 40

Figure 8:
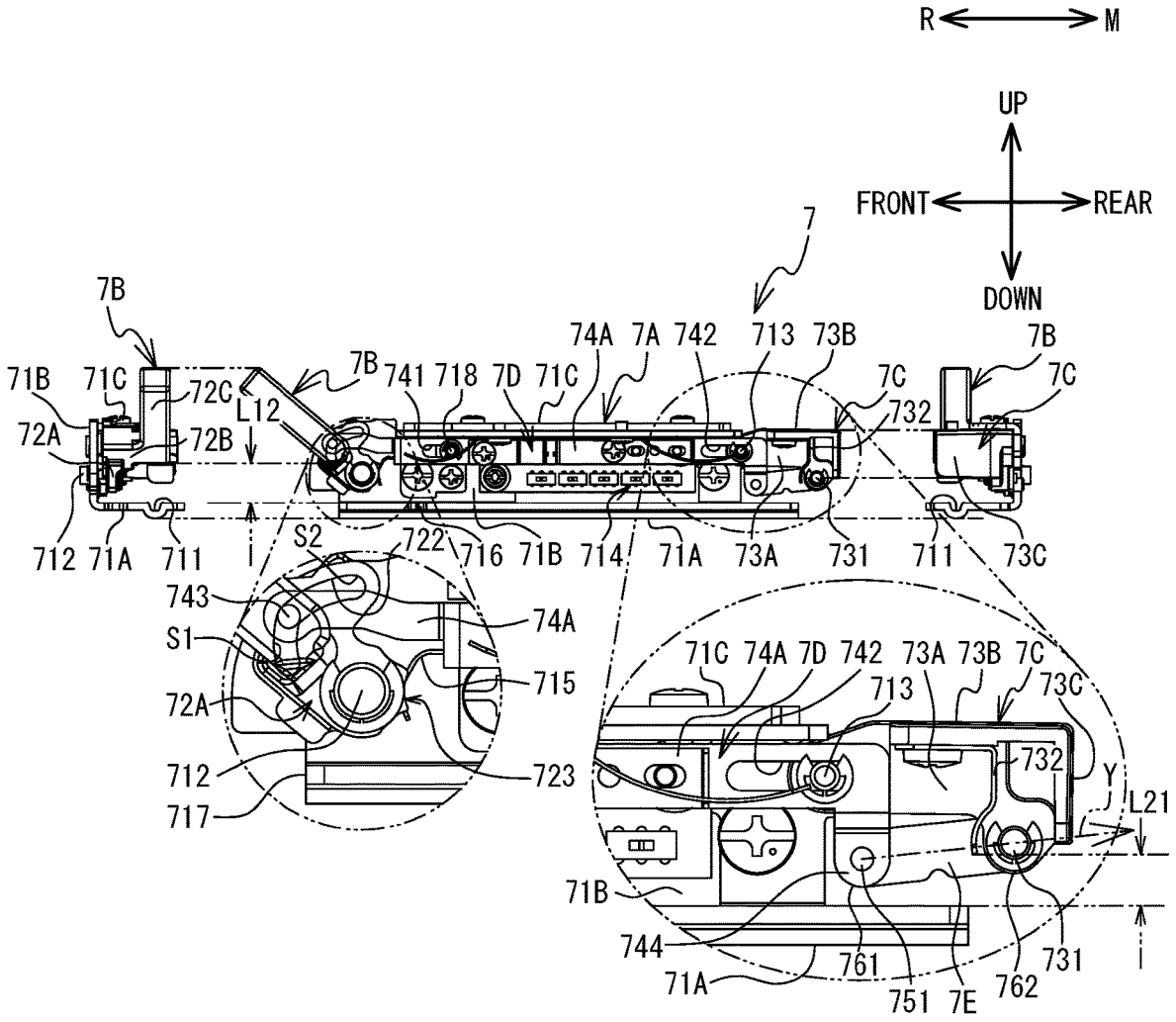
FIG. 8 is a right side view of the embroidery frame transport device 40 (the lever 7B is in a first intermediate position and the locking portion 7C is in the second restriction position)
Figure 11:
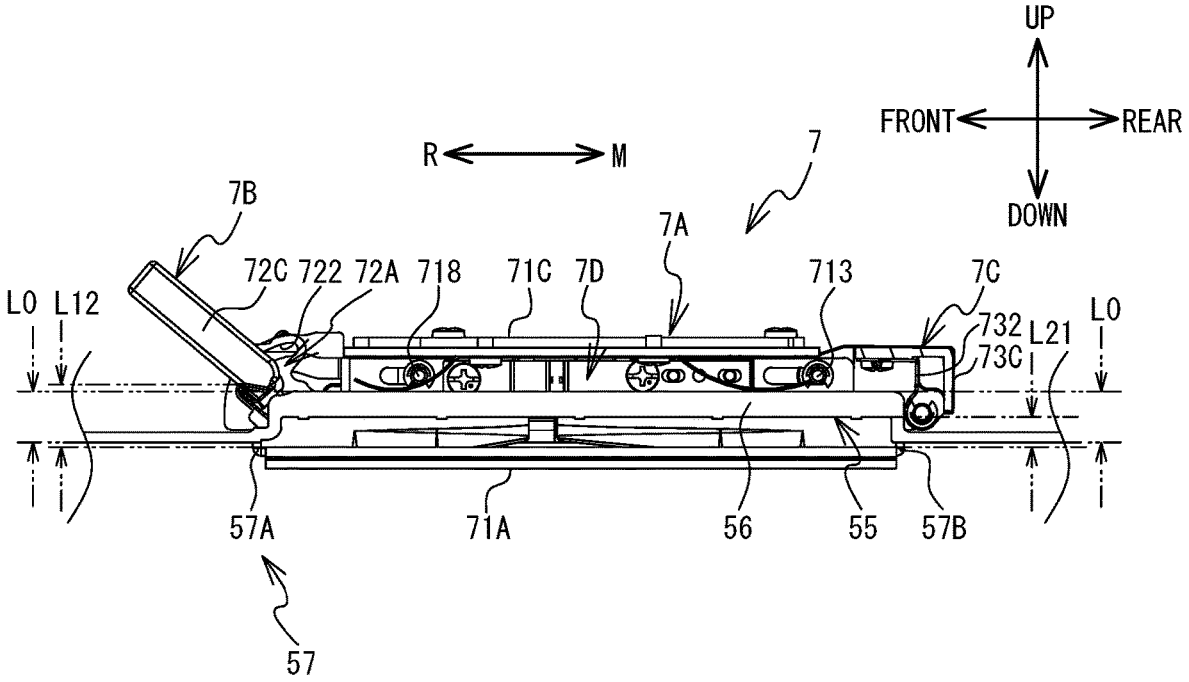
FIG. 11 is a right side view showing the embroidery frame 50 held by the embroidery frame transport device 40 (the lever 7B is in the first intermediate position and the locking portion 7C is in the second restriction position)

In a state in which the embroidery frame 50 is not mounted on the carriage 42 of the embroidery frame transport device 40, the operation portion 72C is operated by the user, and the lever 7B is disposed in the first intermediate position (refer to FIG. 8). In this state, the lever distance L12 is greater than the thickness L0 of the coupling portion 55 of the embroidery frame 50. Therefore, the base portion 56 of the coupling portion 55 is able to be inserted through the inner section of the attachment portion 7A of the holder 7 from the front side. As shown in FIG. 11, when the base portion 56 of the coupling portion 55 moves in the second direction M (the rearward direction) in the inner section of the attachment portion 7A, the guide portion 57 of the coupling portion 55 is guided by the guide portion 711 (refer to FIG. 8) of the plate-shaped portion 71A.

On the other hand, when the lever 7B is in the first intermediate position, the locking portion 7C is disposed in the second restriction position. In this state, the locking distance L21 is less than the thickness L0 of the coupling portion 55 of the embroidery frame 50. Therefore, in the course of the base portion 56 of the coupling portion 55 moving in the second direction M (the rearward direction) in the inner section of the attachment portion 7A, the rear end portion of the base portion 56 comes into contact with the locking plate 732 of the locking portion 7C. As a result, as shown in FIG. 11, the movement of the embroidery frame 50 in the second direction M (the rearward direction) with respect to the embroidery frame transport device 40 is restricted.

Figure 12:
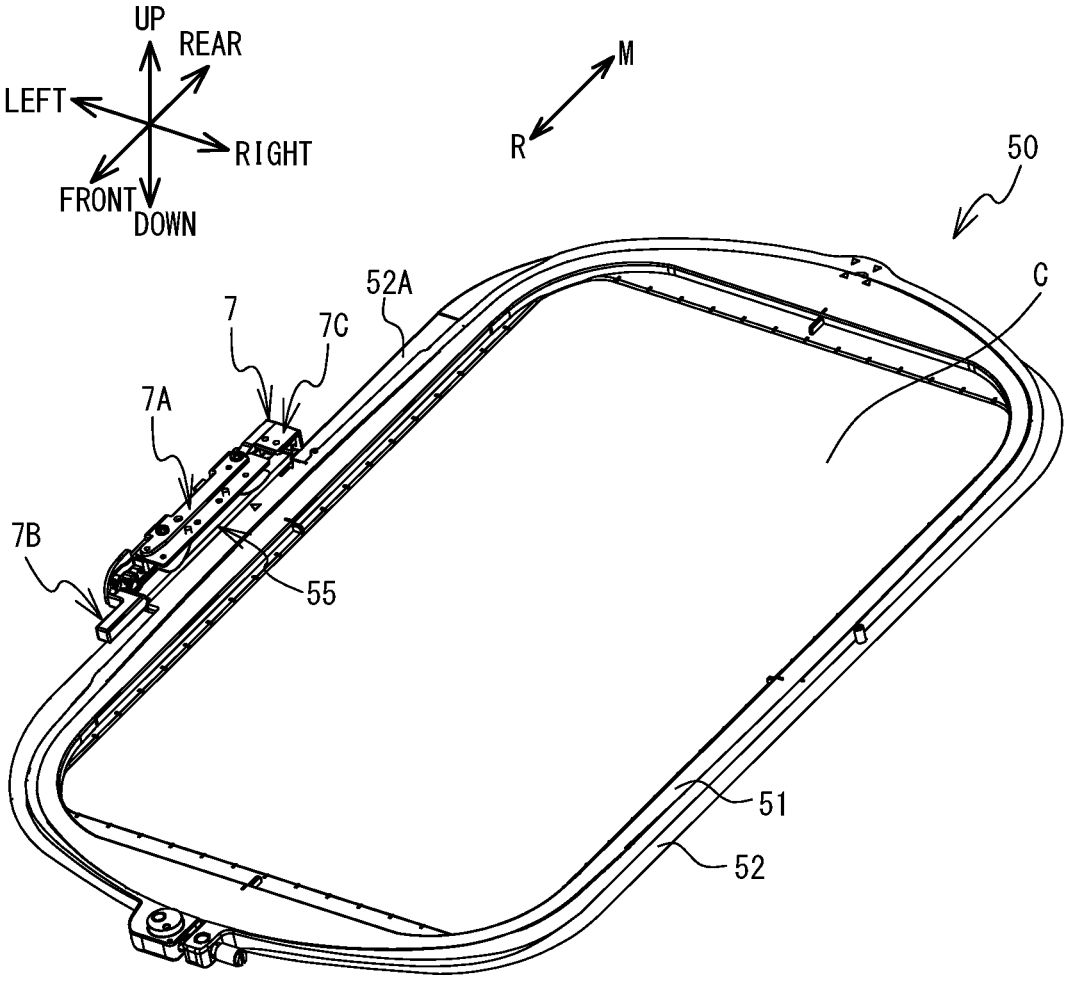
FIG. 12 is a perspective view showing the embroidery frame 50 mounted on the embroidery frame transport device 40 (the lever 7B is in the first restriction position and the locking portion 7C is in the second restriction position)
Figure 13:
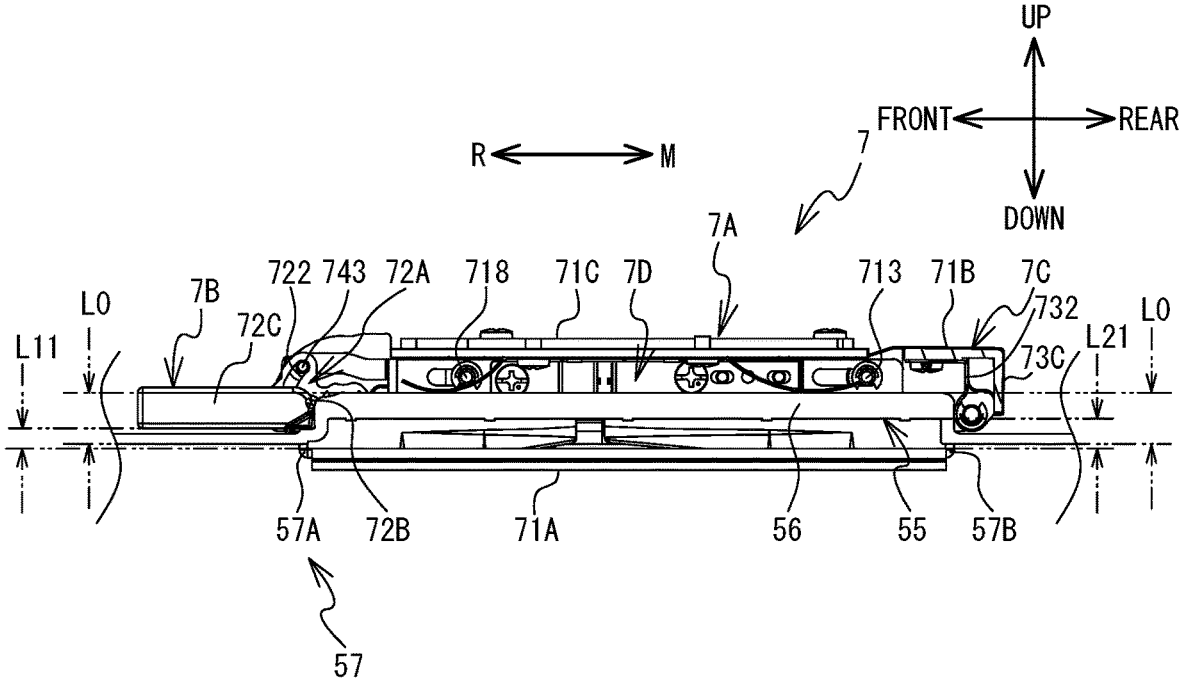
FIG. 13 is a right side view showing the embroidery frame 50 mounted on the embroidery frame transport device 40 (the lever 7B is in the first restriction position and the locking portion 7C is in the second restriction position)

Next, the operation portion 72C is operated by the user, and the lever 7B is rotated from the first intermediate position to the first restriction position. In this state, the lever distance L11 is less than the thickness L0 of the coupling portion 55 of the embroidery frame 50. As shown in FIG. 12 and FIG. 13, the contact portion 72B of the lever 7B comes into contact with the front end portion of the base portion 56 of the coupling portion 55 from the front side, and presses the base portion 56 of the coupling portion 55 rearward against the locking plate 732 of the locking portion 7C. The contact portion 72B of the lever 7B disposed in the first restriction position comes into contact with the front end portion of the base portion 56 from the first direction R side (the front side), and thus the coupling portion 55 is restricted from moving in the first direction R (the forward direction). The locking plate 732 of the locking portion 7C disposed in the second restriction position comes into contact with the rear end portion of the base portion 56 from the second direction M side (the rear side), and thus the coupling portion 55 is restricted from moving in the second direction M (the rearward direction). Through these processes, the mounting of the embroidery frame 50 with respect to the carriage 42 is complete. Hereinafter, a state of the embroidery frame 50 mounted on the carriage 42 is referred to as a "mounted state." When the embroidery frame 50 is in the mounted state, the lever 7B can be disposed in the first restriction position, and the locking portion 7C can be disposed in the second restriction position. As shown in FIG. 6, when the embroidery frame 50 is in the mounted state, the third engagement portion 716 of the attachment portion 7A faces the fourth engagement portion 58 of the coupling portion 55 and engages with the fourth engagement portion 58.

Retraction Operation of Embroidery Frame 50 from Embroidery Frame Transport Device 40

When the embroidery frame 50 is in the mounted state, the operation portion 72C is operated by the user, and the lever 7B is rotated from the first restriction position to the first intermediate position. As shown in FIG. 8, in the state in which the lever 7B is disposed in the first intermediate position, the lever distance L12 is greater than the thickness L0 of the coupling portion 55 of the embroidery frame 50. The contact portion 72B of the lever 7B does not come into contact with the front end portion of the base portion 56 of the coupling portion 55, and a state is achieved in which the movement of the coupling portion 55 in the first direction R (the forward direction) is not restricted. Meanwhile, even when the lever 7B is rotated to the first intermediate position, the locking portion 7C is maintained in the second restriction position. The state in which the locking distance L21 is less than the thickness L0 of the coupling portion 55 of the embroidery frame 50 is maintained, and the state in which the movement of the coupling portion 55 in the second direction M (the rearward direction) is restricted is maintained.

Figure 14:
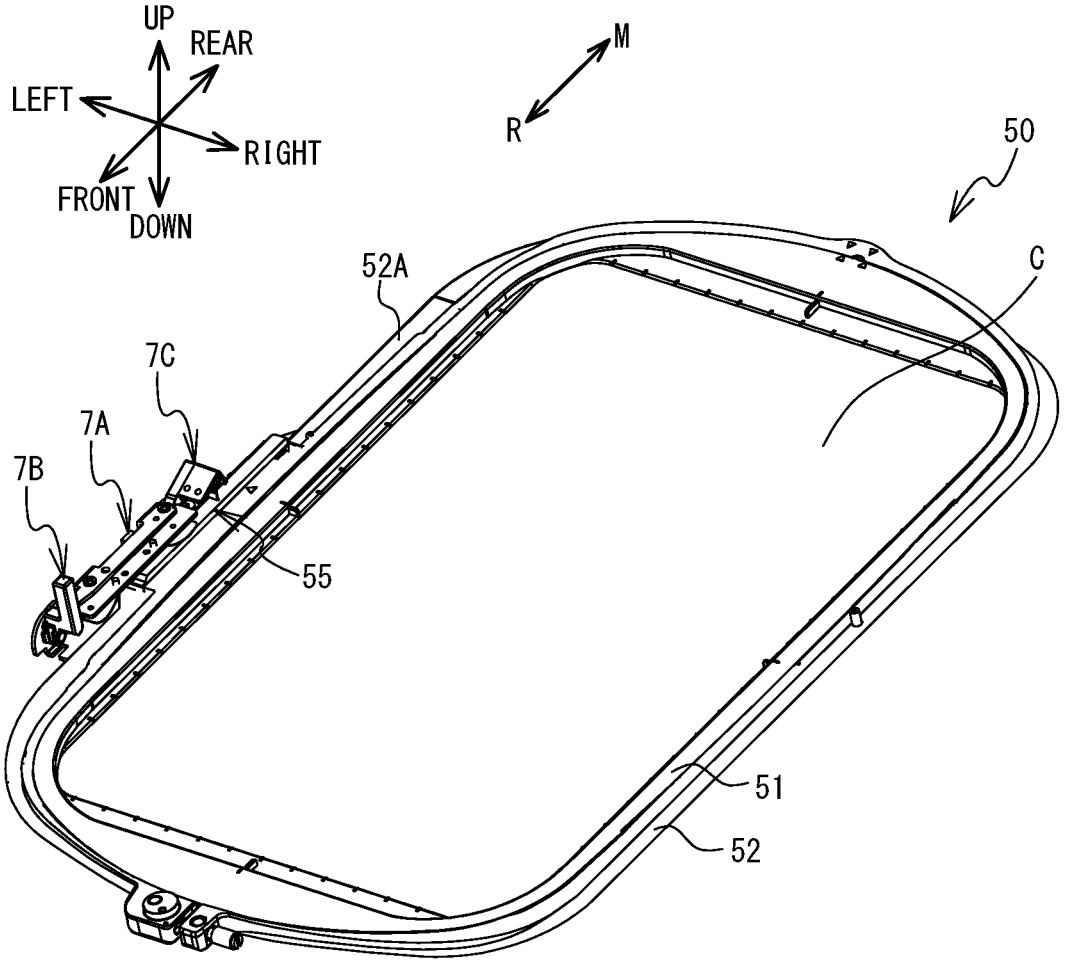
FIG. 14 is a perspective view showing the embroidery frame 50 held by the embroidery frame transport device 40 (the lever 7B is in the first release position and the locking portion 7C is in the second release position)
Figure 15:
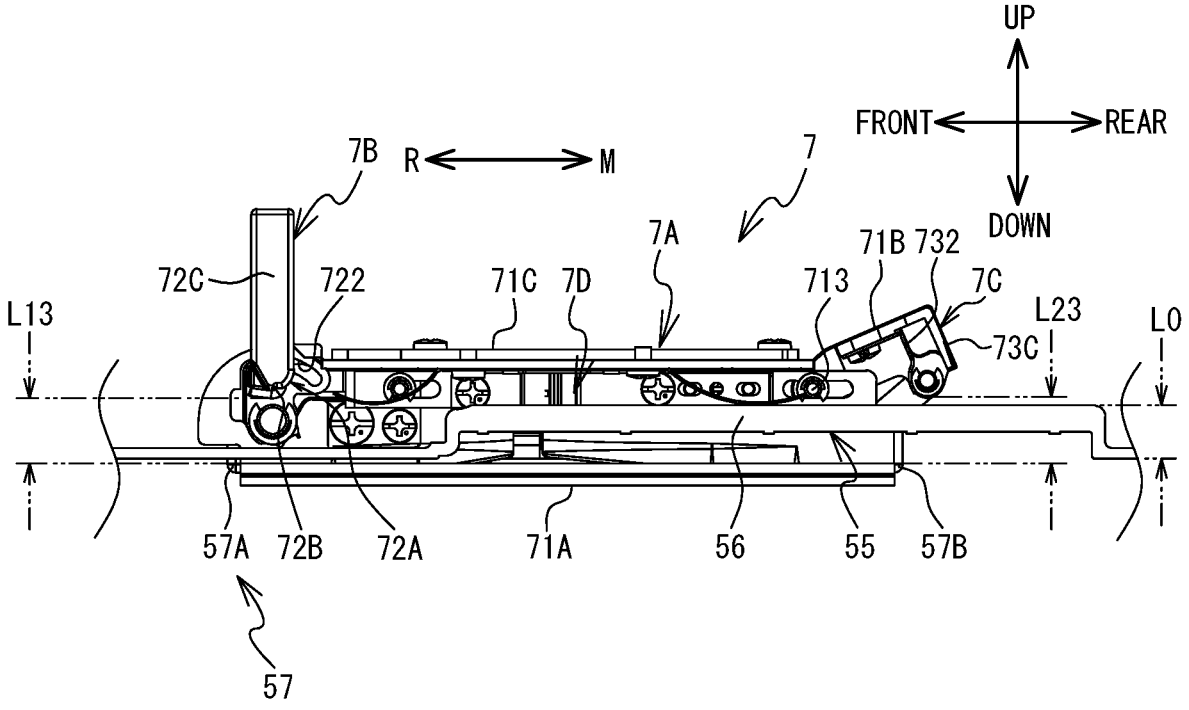
FIG. 15 is a right side view showing the embroidery frame 50 held by the embroidery frame transport device 40 (the lever 7B is in the first release position and the locking portion 7C is in the second release position)

Next, the operation portion 72C is further operated by the user, and the lever 7B is rotated from the first intermediate position to the first release position. In this case, as shown in FIG. 14 and FIG. 15, the lever distance is L13 and is maintained in a state in which it is greater than the thickness L0 of the coupling portion 55 of the embroidery frame 50. The contact portion 72B of the lever 7B does not come into contact with the front end portion of the base portion 56 of the coupling portion 55, and the state in which the movement of the coupling portion 55 in the first direction R (the forward direction) is not restricted is maintained. Meanwhile, the coupling mechanism 7D and the link 7E move due to the rotation of the lever 7B, and cause the locking portion 7C to rotate from the second restriction position to the second release position. In this state, the locking distance L23 is greater than the thickness L0 of the coupling portion 55 of the embroidery frame 50. The locking plate 732 of the locking portion 7C does not come into contact with the front end portion of the coupling portion 55, and a state is achieved in which the movement of the coupling portion 55 in the second direction M (the rearward direction) is not restricted.

Figure 16:
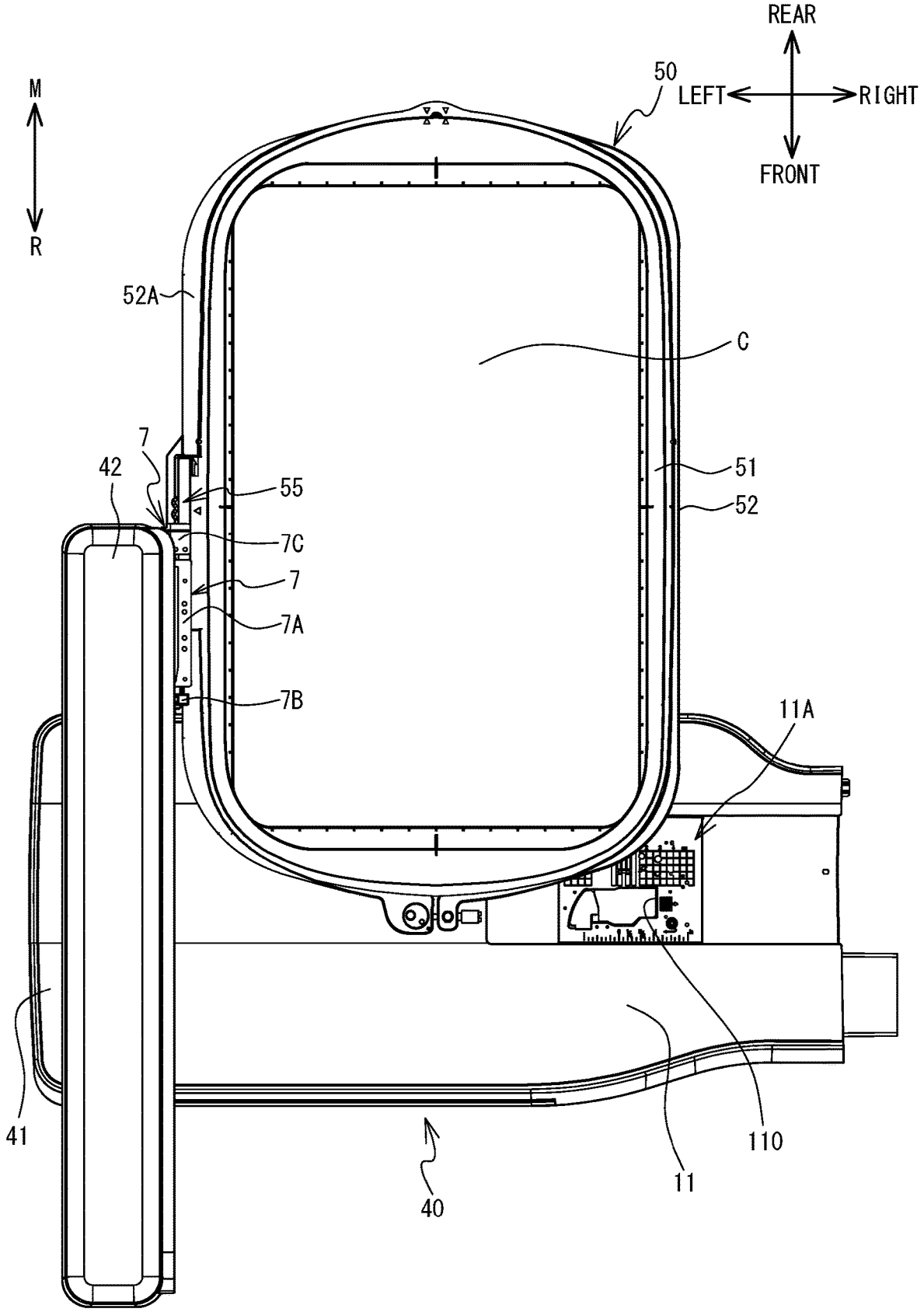
FIG. 16 is a view when the sewing machine 1, on which the embroidery frame 50 is held by the embroidery frame transport device 40 (the lever 7B is in the first release position and the locking portion 7C is in the second release position), is viewed from above.
Figure 17:
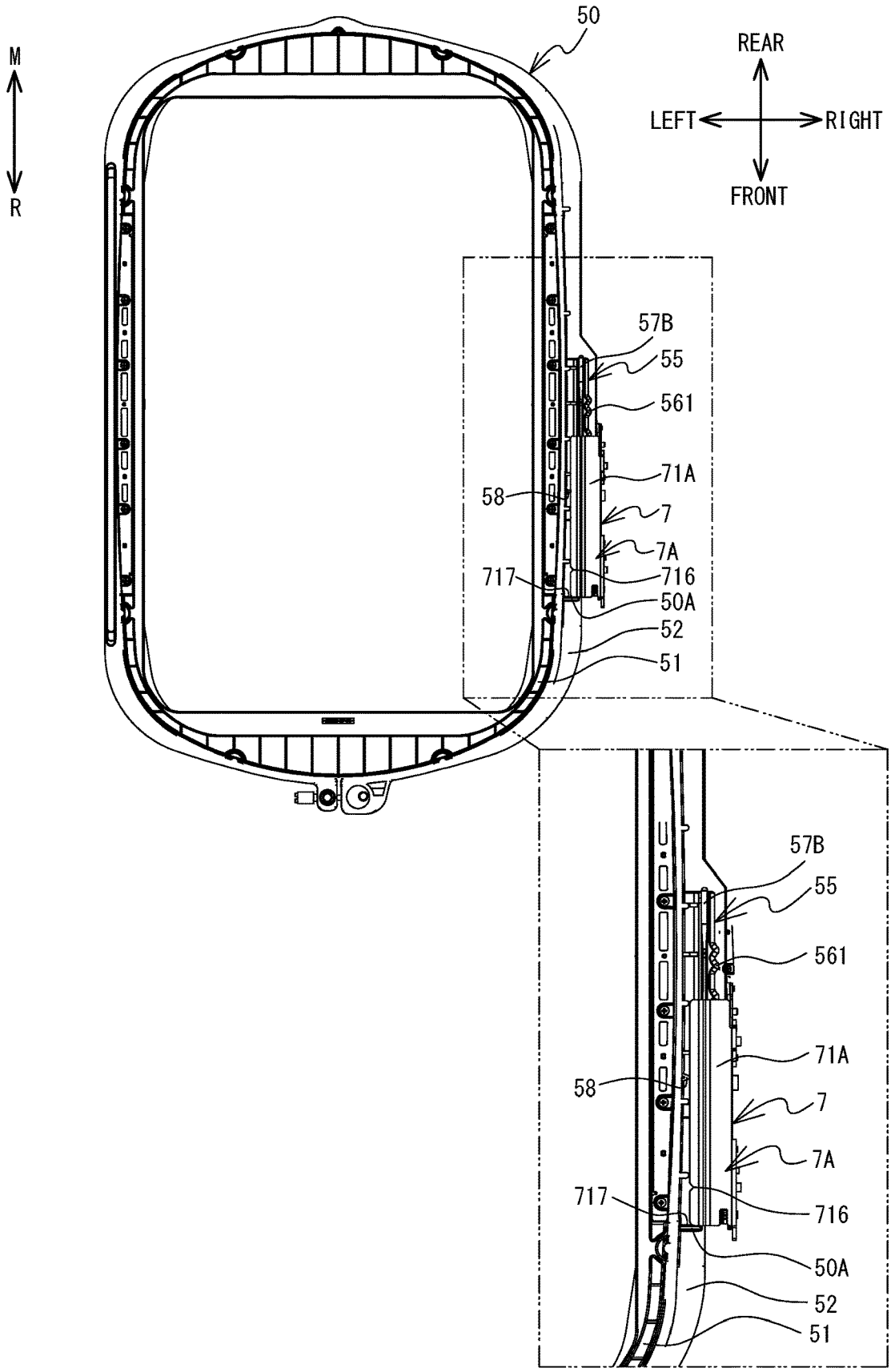
FIG. 17 is a view when the embroidery frame 50 held by the embroidery frame transport device 40 (the lever 7B is in the first intermediate position and the locking portion 7C is in the second restriction position) is viewed from below.

Next, the embroidery frame 50 is moved in the second direction M (the rearward direction) by the user. FIG. 16 shows a state in which the embroidery frame 50 is moved in the second direction M (the rearward direction) by the user in the state in which the holder 7 is moved to the rearmost side within the movable range by the Y axis movement mechanism. As shown in FIG. 16, the needle plate 11A, particularly, the bobbin insertion opening 110 is not covered from above by the sewing object C held by the embroidery frame 50. Thus, the user can replace the lower thread bobbin via the bobbin insertion opening 110 of the needle plate 11A. As shown in FIG. 17, the movement of the embroidery frame 50 in the second direction M (the rearward direction) is restricted by the front end portion (hereinafter referred to as a "restriction portion 717") of the plate-shaped portion 71A of the attachment portion 7A of the holder 7 coming into contact with the contact portion 50A of the embroidery frame 50 from the rear side.

When the sewing is re-started using the sewing machine 1, the embroidery frame 50 is moved in the first direction R (the forward direction) by the user. As shown in FIG. 6, the fourth engagement portion 58 of the embroidery frame 50 engages with the third engagement portion 716 of the attachment portion 7A, and thus, the embroidery frame 50 is restricted from moving in the first direction R (the forward direction) with respect to the holder 7. As a result, the embroidery frame 50 is positioned in the front-rear direction with respect to the holder 7. When the operation portion 72C is operated by the user and the lever 7B is rotated from the first release position to the first restriction position, the locking portion 7C also rotates from the second release position to the second restriction position, as shown in FIG. 12 and FIG. 13. As a result, the base portion 56 of the coupling portion 55 is restricted from moving in both the first direction R (the forward direction) and the second direction M (the rearward direction) by the contact portion 72B of the lever 7B and the locking plate 732 of the locking portion 7C. The embroidery frame 50 returns to the original mounted state.

Operations and Effects of Embodiment

In the embroidery frame transport device 40, when the lever 7B is rotated from the first release position to the first restriction position, the coupling mechanism 7D causes the locking portion 7C to rotate from the second release position to the second restriction position. In this way, the embroidery frame transport device 40 causes the lever 7B and the locking portion 7C to come into contact with the coupling portion 55 of the embroidery frame 50 in the mounted state, from both the first direction R side and the second direction M side, and can thus restrict the movement of the embroidery frame 50. Therefore, by transporting the embroidery frame 50 in this state, the embroidery frame transport device 40 can make it possible to perform the embroidery sewing on the sewing object C held by the embroidery frame 50.

On the other hand, when the lever 7B is rotated from the first restriction position to the first release position, the coupling mechanism 7D causes the locking portion 7C to rotate from the second restriction position to the second release position. In this case, a state is achieved in which the lever 7B and the locking portion 7C do not come into contact with the coupling portion 55 of the embroidery frame 50 in the mounted state, on both the first direction R side and the second direction M side. In this case, the embroidery frame 50 is able to move in the first direction R and the second direction M. For example, by moving the embroidery frame 50 in the second direction M, the user can retract the embroidery frame 50 from above the bobbin insertion opening 110 without completely removing the embroidery frame 50 from the carriage 42. Therefore, the embroidery frame transport device 40 can increase the possibility that the sewing object C held by the embroidery frame 50 can be retracted from above the bobbin insertion opening 110 of the needle plate 11A.

The lever 7B rotates between the first restriction position and the first release position via the first intermediate position. In the state in which the lever 7B is disposed in the first intermediate position, the lever 7B does not come into contact with the coupling portion 55 of the embroidery frame 50 in the mounted state from the first direction R side, and does not restrict the movement of the embroidery frame 50 in the first direction R. On the other hand, while the lever 7B is rotating from the first restriction position to the first intermediate position, the coupling mechanism 7D maintains the locking portion 7C in the second restriction position. In the state in which the lever 7B is disposed in the first intermediate position, the movement of the embroidery frame 50 is not restricted by the lever 7B. Therefore, the user can move the embroidery frame 50 in the second direction M, and thus can guide the embroidery frame 50 to the guide portion 711 of the attachment portion 7A. Meanwhile, since the locking portion 7C is maintained in the second restriction position, the movement of the embroidery frame 50 in the second direction M is restricted in a state in which the locking portion 7C is in contact with the second direction M side of the embroidery frame 50. In this case, the embroidery frame 50 is positioned in the front-rear direction while being in the mounted state. Therefore, the user can easily perform the operation to mount the embroidery frame 50 on the embroidery frame transport device 40.

The lever 7B is provided with the first engagement portion 723. The attachment portion 7A is provided with the second engagement portion 715. In the state in which the lever 7B is disposed in the first intermediate position, the first engagement portion 723 and the second engagement portion 715 are engaged with each other. On the other hand, in the state in which the lever 7B is disposed further to the first restriction position side than the first intermediate position, and in the state in which the lever 7B is disposed further to the first release position side than the first intermediate position, the first engagement portion 723 and the second engagement portion 715 do not engage with each other. In this case, the rotation of the lever 7B is inhibited in the state in which the lever 7B is disposed in the first intermediate position. Therefore, the user who operates the lever 7B can easily recognize that the lever 7B is disposed in the first intermediate position.

The embroidery frame transport device 40 is provided with the third engagement portion 716 that can engage with the fourth engagement portion 58 of the coupling portion 55.

The third engagement portion 716 is disposed at a position facing the fourth engagement portion 58 when the embroidery frame 50 is in the mounted state. In this case, the movement of the embroidery frame 50 in the first direction R or the second direction M with respect to the embroidery frame transport device 40 is inhibited when the fourth engagement portion 58 engages with the third engagement portion 716. Therefore, since the user can easily position the embroidery frame 50 in the mounted state, the user can easily mount the embroidery frame 50 on the embroidery frame transport device 40.

When the coupling mechanism 7D moves in the second direction M due to the rotation of the lever 7B, the locking portion 7C rotates from the second restriction position to the second release position. On the other hand, when the coupling mechanism 7D moves in the first direction R due to the rotation of the lever 7B, the locking portion 7C rotates from the second release position to the second restriction position. Here, the locking portion 7C rotates around the second rotary shaft 713, and is coupled to the coupling mechanism 7D further to the second direction M side than the second rotary shaft 713. In this case, the embroidery frame transport device 40 can efficiently transmit, to the locking portion 7C, the force of the coupling mechanism 7D that moves in accordance with the rotation of the lever 7B, and can cause the locking portion 7C to rotate to the second restriction position and to the second release position.

The one end portion 761 of the link 7E is rotatably coupled to the coupling mechanism 7D, and the other end portion 762 is rotatably coupled to the locking portion 7C. Here, the one end portion 761 of the link 7E is disposed lower than the second rotary shaft 713. The direction from the one end portion 761 to the other end portion 762 of the link 7E is inclined upward with respect to the second direction M. In this case, when the coupling mechanism 7D moves in the second direction M in accordance with the rotation of the lever 7B, the embroidery frame transport device 40 can appropriately move a coupling section of the locking portion 7C with the link 7E upward, and can cause the locking portion 7C to rotate from the second restriction position to the second release position.

The embroidery frame 50 has the contact portion 50A that is provided further to the first direction R side than the coupling portion 55. In the state in which the locking portion 7C is disposed in the second release position, when the embroidery frame 50 moves in the second direction M along the guide portion 711, the restriction portion 717 of the attachment portion 7A comes into contact with the contact portion 50A of the embroidery frame 50 from the first direction R side, and thereby restricts the movement of the embroidery frame 50 in the second direction M. In this case, by causing the restriction portion 717 to come into contact with the contact portion 50A, the sewing machine 1 can inhibit the coupling portion 55 from disengaging from the embroidery frame transport device 40 due to the movement of the embroidery frame 50 in the second direction M.

MODIFIED EXAMPLES

The present disclosure is not limited to the above-described embodiment, and various modifications are possible. The configuration of the sewing machine 1 may be changed as appropriate. The sewing machine 1 may be an industrial sewing machine or may be a multi-needle sewing machine. It is sufficient that the embroidery frame transport device 40 can relatively move the holder 7, with respect to the needle bar 6, in the first direction R and in the direction intersecting the first direction R. The embroidery frame transport device 40 may be formed integrally with the sewing machine 1. It is sufficient that the embroidery frame 50 that can be mounted on the embroidery frame transport device 40 be provided with the first frame 51, the second frame 52 and the coupling portion 55. For example, the embroidery frame 50 may clamp the sewing object C in the up-down direction. The size and shape of the embroidery frame 50 may be changed as appropriate. The configuration of the coupling portion 55 may be changed as appropriate.

In the state in which the lever 7B is disposed in the first intermediate position, the locking portion 7C may be disposed in a second intermediate position that is between the second restriction position and the second release position. In a state in which the locking portion 7C is disposed in the second intermediate position, the locking plate 732 of the locking portion 7C need not necessarily come into contact with the rear end portion of the base portion 56 of the coupling portion 55 of the embroidery frame 50. The shapes of the first engagement portion 723 and the second engagement portion 715 are not limited to those of the above-described embodiment. For example, the first engagement portion 723 may have a convex shape and the second engagement portion 715 may have a concave shape that can be engaged with the convex first engagement portion 723. The embroidery frame transport device 40 need not necessarily have the first engagement portion 723 and the second engagement portion 715. The shapes of the third engagement portion 716 and the fourth engagement portion 58 are not limited to those of the above-described embodiment. For example, the fourth engagement portion 58 may be movable in the left-right direction, and an urging portion that urges the fourth engagement portion 58 to the left may be provided. The embroidery frame transport device 40 need not necessarily have the third engagement portion 716, and the embroidery frame 50 need not necessarily have the fourth engagement portion 58. The coupling mechanism 7D may be directly coupled to the locking portion 7C, without being coupled via the link 7E. In this case, the coupling section of the coupling mechanism 7D and the locking portion 7C may be disposed further to the first direction R side (the front side) than the second rotary shaft 713. The direction extending from the one end portion 761 to the other end portion 762 of the link 7E may extend horizontally in the second direction M (the rearward direction) when the locking portion 7C is disposed in the second restriction position. The movement of the embroidery frame 50 in the second direction M may be restricted by the contact portion 50A engaging with the third engagement portion 716 of the attachment portion 7A.

The locking portion 7C and the lever 7B need not necessarily be coupled by the coupling mechanism 7D. The locking portion 7C may be configured to rotate between the second restriction position and the second release position, independently from the rotation of the lever 7B. In this case, it is sufficient that the coupling mechanism 7D be omitted from the above-described embodiment. The present disclosure is not limited to the embodiment in which the movement of the embroidery frame 50 in the front-rear direction is restricted by the locking portion 7C and the lever 7B respectively rotating between the release position and the restriction position. For example, each of the locking portion 7C and the lever 7B may come into contact with the coupling portion 55 of the embroidery frame 50 by sliding in the up-down direction or the left-right direction, and thus, the movement of the embroidery frame 50 in the front-rear direction may be restricted.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery frame transport device comprising:

a guide portion provided on a carriage on which a coupling portion of an embroidery frame is configured to be mounted and removed, the guide portion being configured to prescribe a first direction that is a movement direction of the embroidery frame when the embroidery frame is removed, and a second direction that is a movement direction of the embroidery frame when the embroidery frame is mounted;

a lever configured to move between a first restriction position that restricts the movement in the first direction of the embroidery frame in a mounted state in which the embroidery frame is mounted on the carriage, and a first release position that does not restrict the movement in the first direction of the embroidery frame in the mounted state; and a locking portion configured to move between a second restriction position that restricts the movement in the second direction of the embroidery frame in the mounted state, and a second release position that does not restrict the movement in the second direction of the embroidery frame in the mounted state.

2. The embroidery frame transport device according to claim 1, wherein in a state in which the lever is disposed in the first restriction position, the lever comes into contact, from the first direction side, with the coupling portion of the embroidery frame in the mounted state, and in a state in which the lever is disposed in the first release position, the lever does not come into contact, from the first direction side, with the coupling portion of the embroidery frame in the mounted state, and in a state in which the locking portion is disposed in the second restriction position, the locking portion comes into contact, from the second direction side, with the coupling portion of the embroidery frame in the mounted state, and in a state in which the locking portion is disposed in the second release position, the locking portion does not come into contact, from the second direction side, with the coupling portion of the embroidery frame in the mounted state.

3. The embroidery frame transport device according to claim 1, wherein the lever is configured to rotate around a first rotary shaft, between the first restriction position and the first release position, and the locking portion is configured to rotate around a second rotary shaft different from the first rotary shaft, between the second restriction position and the second release position.

4. The embroidery frame transport device according to claim 3, further comprising:

a coupling mechanism configured to couple the lever and the locking portion, the coupling mechanism causing the locking portion to rotate from the second restriction position to the second release position when the lever is rotated from the first restriction position to the first release position, and causing the locking portion to rotate from the second release position to the second restriction position when the lever is rotated from the first release position to the first restriction position.

5. The embroidery frame transport device according to claim 4, wherein the lever rotates between the first restriction position and the first release position via a first intermediate position that does not restrict the movement in the first direction of the embroidery frame in the mounted state, in a state in which the lever is disposed in the first intermediate position, the lever does not come into contact, from the first direction side, with the coupling portion of the embroidery frame in the mounted state, and while the lever is being rotated from the first restriction position to the first intermediate position, the coupling mechanism maintains the locking portion in the second restriction position, and when the lever is rotated from the first intermediate position to the first release position, the coupling mechanism causes the locking portion to rotate from the second restriction position to the second release position.

6. The embroidery frame transport device according to claim 5, further comprising:

a first engagement portion provided on the lever; and a second engagement portion configured to engage with the first engagement portion in the state in which the lever is disposed in the first intermediate position, and configured to not engage with the first engagement portion in a state in which the lever is disposed further to the first restriction position side than the first intermediate position, and in a state in which the lever is disposed further to the first release position side than the first intermediate position.

7. The embroidery frame transport device according to claim 1, further comprising:

a third engagement portion configured to engage with a fourth engagement portion of the coupling portion, the third engagement portion being provided at a position facing the fourth engagement portion of the coupling portion of the embroidery frame in the mounted state.

8. The embroidery frame transport device according to claim 4, wherein the coupling mechanism moves in the second direction when the lever rotates from the first restriction position to the first release position, and moves in the first direction when the lever rotates from the first release position to the first restriction position, the locking portion rotates around the second rotary shaft that is orthogonal to the first direction and the second direction, and is coupled to the coupling mechanism further to the second direction side than the second rotary shaft, and the locking portion rotates from the second restriction position to the second release position when the coupling mechanism moves in the second direction, and rotates from the second release position to the second restriction position when the coupling mechanism moves in the first direction.

9. The embroidery frame transport device according to claim 8, further comprising:

a link whose one end portion is rotatably coupled to the coupling mechanism and whose other end portion is rotatably coupled to the locking portion, wherein the locking portion and the coupling portion are coupled via the link, and the one end portion of the link is disposed on a first side, which is further to one side than the second rotary shaft in an orthogonal direction that is orthogonal to the first direction, the second direction and the second rotary shaft, and a direction from the one end portion toward the other end portion of the link is inclined, with respect to the second direction, toward a second side opposite to the first side in the orthogonal direction.

10. A sewing machine comprising:

an embroidery frame transport device including a guide portion provided on a carriage on which a coupling portion of an embroidery frame is configured to be mounted and removed, the guide portion being configured to prescribe a first direction that is a movement direction of the embroidery frame when the embroidery frame is removed, and a second direction that is a movement direction of the embroidery frame when the embroidery frame is mounted, a lever configured to move between a first restriction position that restricts the movement in the first direction of the embroidery frame in a mounted state in which the embroidery frame is mounted on the carriage, and a first release position that does not restrict the movement in the first direction of the embroidery frame in the mounted state, and a locking portion configured to move between a second restriction position that restricts the movement in the second direction of the embroidery frame in the mounted state, and a second release position that does not restrict the movement in the second direction of the embroidery frame in the mounted state; and the embroidery frame including a contact portion which is provided on a frame portion configured to clamp a sewing object, and which is provided further to the first direction side than the coupling portion in the mounted state, wherein the embroidery frame transport device further includes a restriction portion that restricts the movement of the embroidery frame in the second direction by coming into contact with the contact portion of the embroidery frame that is moved in the second direction along the guide portion, in a state in which the locking portion is disposed in the second release position.

* * * * *